US009353975B2

(12) United States Patent
Takayama et al.

(10) Patent No.: US 9,353,975 B2
(45) Date of Patent: May 31, 2016

(54) REFRIGERATION CYCLE APPARATUS WITH AN EXPANDER TO RECOVER POWER FROM REFRIGERANT

(75) Inventors: Keisuke Takayama, Tokyo (JP); Yusuke Shimazu, Tokyo (JP); Masayuki Kakuda, Tokyo (JP); Hideaki Nagata, Tokyo (JP); Takeshi Hatomura, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 716 days.

(21) Appl. No.: 13/394,970

(22) PCT Filed: Sep. 24, 2009

(86) PCT No.: PCT/JP2009/066484

§ 371 (c)(1),
(2), (4) Date: Mar. 8, 2012

(87) PCT Pub. No.: WO2011/036741

PCT Pub. Date: Mar. 31, 2011

(65) Prior Publication Data

US 2012/0174610 A1 Jul. 12, 2012

(51) Int. Cl.
*F25B 9/00* (2006.01)
*F25B 41/00* (2006.01)
(Continued)

(52) U.S. Cl.
CPC . *F25B 1/10* (2013.01); *F25B 11/02* (2013.01); *F25B 13/00* (2013.01); *F25B 43/006* (2013.01);
(Continued)

(58) Field of Classification Search
CPC ..... F25B 11/02; F25B 2400/04; F25B 2400/0401; F25B 2400/0409; F25B 43/006; F25B 2309/005; F25B 2400/14; F25B 2400/16; F25B 2600/2501; F25B 2700/19; F25B 2700/191
USPC ..... 62/510, 513, 402, 196.1, 197, 198, 87, 62/509, 125, 127
See application file for complete search history.

(56) References Cited

U.S. PATENT DOCUMENTS 4,086,072 A * 4/1978 Shaw ..... 62/160
5,833,446 A * 11/1998 Smith et al. ..... 418/201.1
(Continued)

FOREIGN PATENT DOCUMENTS

JP 2003-65615 A 3/2003
JP 2006-125790 5/2006
(Continued)

OTHER PUBLICATIONS

International Search Report (PCT/ISA/210) issued on Dec. 8, 2009, by Japanese Patent Office as the International Searching Authority for International Application No. PCT/JP2009/066484.
(Continued)

*Primary Examiner* — Mohammad M Ali
*Assistant Examiner* — Daniel C Comings
(74) *Attorney, Agent, or Firm* — Buchanan Ingersoll & Rooney PC

(57) ABSTRACT

A refrigeration cycle apparatus includes a refrigeration cycle formed by a first compressor, a radiator, an expander that expands a refrigerant that has passed through the radiator, and an evaporator. A bypass piping has one end connected to a discharge piping of the expander and the other end connected to a suction piping of the first compressor. A pressure sensor and a temperature sensor detect the suction pressure and suction temperature of the expander as physical quantities of the refrigerant to be sucked into the expander. A bypass valve controls the flow rate of the refrigerant. A control device determines the appropriate discharge pressure of the expander on the basis of the suction pressure and suction temperature of the expander, and opens the bypass valve when the pressure at which the expander discharges the refrigerant is higher than the determined appropriate discharge pressure.

7 Claims, 10 Drawing Sheets

(51) Int. Cl.

| | |
|---|---|
| ***F25B 49/00*** | (2006.01) |
| ***F25B 1/10*** | (2006.01) |
| ***F25B 39/04*** | (2006.01) |
| ***F25B 11/02*** | (2006.01) |
| *F25B 43/00* | (2006.01) |
| *F25B 13/00* | (2006.01) |

(52) U.S. Cl.
CPC . *F25B 2309/061* (2013.01); *F25B 2313/02742* (2013.01); *F25B 2400/0409* (2013.01); *F25B 2400/14* (2013.01); *F25B 2400/16* (2013.01); *F25B 2500/26* (2013.01); *F25B 2600/2501* (2013.01); *F25B 2700/19* (2013.01); *F25B 2700/191* (2013.01)

(56) References Cited

U.S. PATENT DOCUMENTS

| | | | | |
|---|---|---|---|---|
| 5,987,907 | A * | 11/1999 | Morimoto | F25B 9/006 62/212 |
| 6,202,431 | B1 * | 3/2001 | Beaverson et al. | 62/196.3 |
| 2009/0301109 | A1 * | 12/2009 | Manole | 62/79 |
| 2010/0058783 | A1 * | 3/2010 | Lifson | F25B 9/06 62/115 |
| 2010/0077777 | A1 * | 4/2010 | Lifson | F25B 9/008 62/117 |
| 2010/0170295 | A1 * | 7/2010 | Okazaki et al. | 62/510 |

FOREIGN PATENT DOCUMENTS

| | | | |
|---|---|---|---|
| JP | 2008-14602 | A | 1/2008 |
| JP | 2009-079850 | | 4/2009 |
| JP | 2009-162438 | | 7/2009 |
| WO | WO 2008/146709 | A1 | 12/2008 |

OTHER PUBLICATIONS

Office Action (Decision of Refusal) issued on Apr. 1, 2014, by the Japanese Patent Office in corresponding Japanese Patent Application No. 2011-532820, and an English Translation of the Office Action. (5 pages).

Office Action (Notification of the First Office Action) issued on Sep. 13, 2013, by the Chinese Patent Office in corresponding Chinese Patent Application No. 200980161601.8, and an English Translation of the Office Action. (11 pages).

Office Action (Notice of Reasons for Refusal) issued on Sep. 10, 2013, by the Japanese Patent Office in corresponding Japanese Patent Application No. 2011-532820, and an English Translation of the Office Action. (4 pages).

* cited by examiner

REFRIGERATION CYCLE APPARATUS WITH AN EXPANDER TO RECOVER POWER FROM REFRIGERANT

TECHNICAL FIELD

The present invention relates to a refrigeration cycle apparatus using a refrigerant, such as a fluid that is brought into a supercritical state, and particularly, to a refrigeration cycle apparatus equipped with an expander that recovers the fluid energy as power during its expansion process.

BACKGROUND ART

In the related art, as a refrigeration cycle apparatus equipped with an expander that recovers the fluid energy as power during its expansion process, for example, there is a refrigeration cycle apparatus equipped with a first compressor that is driven by an electric motor to compress refrigerant, a radiator that rejects the heat of the refrigerant compressed by the first compressor, an expander that decompresses the refrigerant that has passed through the radiator, an evaporator in which the refrigerant decompressed by the expander evaporates, and a second compressor that is driven by the expansion power recovered in the expander and has a discharge side connected to a suction side of the first compressor (for example, refer to Patent Literature 1).

Additionally, there is a refrigeration cycle apparatus equipped with a first compressor, a radiator that rejects the heat of refrigerant compressed by the first compressor, an expander that decompresses the refrigerant that has passed through the radiator, an evaporator in which the refrigerant decompressed by the expander evaporates, and a supercharger (a second compressor) that raises the pressure of the refrigerant evaporated in the evaporator and supplies the refrigerant to the first compressor (for example, refer to Patent Literature 2).

CITATION LIST

Patent Literature

Patent Literature 1: JP-2006-126790A (FIG. 4, Abstract)
Patent Literature 2: JP-2009-79850A (FIG. 2, Abstract)

SUMMARY OF INVENTION

Technical Problem

In the refrigeration cycle apparatus of the related art described in the above Patent Literature 1, a supercooling heat exchanger that supercools the refrigerant that flows out of the expander is provided on the discharge side of the expander, and in the supercooling heat exchanger, among a mainstream portion and a substream portion through which the refrigerant passes, one end of the substream portion is connected to a bypass piping bypassed from a piping that connects the expander and the mainstream portion via a supercooling expansion valve, and the other end of the substream portion is connected to a suction side of the first compressor. The efficiency of a refrigeration cycle can be improved by supercooling the refrigerant that flows out of the expander with the supercooling heat exchanger. However, when the supercooling expansion valve is opened in this bypass circuit, the pressure on the discharge side of the expander cannot be made low, and when the refrigerant bypassing an outdoor heat exchanger or an indoor heat exchanger functioning as a radiator or an evaporator increases, the discharge pressure of the expander may rise instead.

Additionally, in the refrigeration cycle apparatus of the related art described in the above Patent Literature 2, a bypass path is provided to bypass the refrigerant to a suction side of the first compressor from a discharge side of the expander, and an opening/closing valve is provided in the bypass path. When the first compressor starts, the refrigerant in the refrigerant circuit from an outlet of the expander to a suction port of the second compressor is supplied to the compressor not through the second compressor but through the bypass path. Thereby, shortage of supply of the refrigerant to the compressor at the time of start is prevented and the pressure differential between the suction side and discharge side of the expander is increased, thereby solving poor starting of the expander. However, since the opening/closing valve is closed with the detection of the start of the second compressor, after the second compressor has been started, the rotation of the second compressor and the expander are disadvantageously unstable until the discharge pressure of the expander reaches an appropriate expansion pressure.

The invention has been made to solve the above problem, and an object thereof is to provide a refrigeration cycle apparatus that can stably recover power with an expander.

Solution to Problem

A refrigeration cycle apparatus according to the invention includes: a refrigeration cycle formed by sequentially connecting with pipes a first compressor that compresses a refrigerant, a radiator that rejects the heat of the refrigerant compressed by the first compressor, an expander that expands the refrigerant that has passed through the radiator and recovers power from the refrigerant, and an evaporator that evaporates the refrigerant expanded by the expander; a first bypass piping having one end connected to a discharge piping of the expander and the other end connected to a suction piping of the first compressor; physical quantity detecting means that detects a physical quantity of the refrigerant to be sucked into the expander; a first bypass valve provided in the first bypass piping to control the flow rate of the refrigerant; and control means that controls an opening degree of the first bypass valve, in which the control means determines an appropriate discharge pressure of the expander on the basis of the physical quantity detected by the physical quantity detecting means and opens the first bypass valve when an pressure at which the expander discharges the refrigerant is higher than the determined appropriate discharge pressure.

Advantageous Effects of Invention

According to the refrigeration cycle apparatus relating to the invention, when the discharge pressure of the expander is higher than the appropriate discharge pressure due to the operating state of the refrigeration cycle apparatus, the first bypass valve is opened to bypass the refrigerant from the discharge piping of the expander to the suction side of the first compressor. Thus, the discharge pressure of the expander can be made low. This can prevent the expander from overexpanding and can stabilize the rotation of the expander.

DESCRIPTION OF EMBODIMENTS

Embodiment 1

Figure 1:
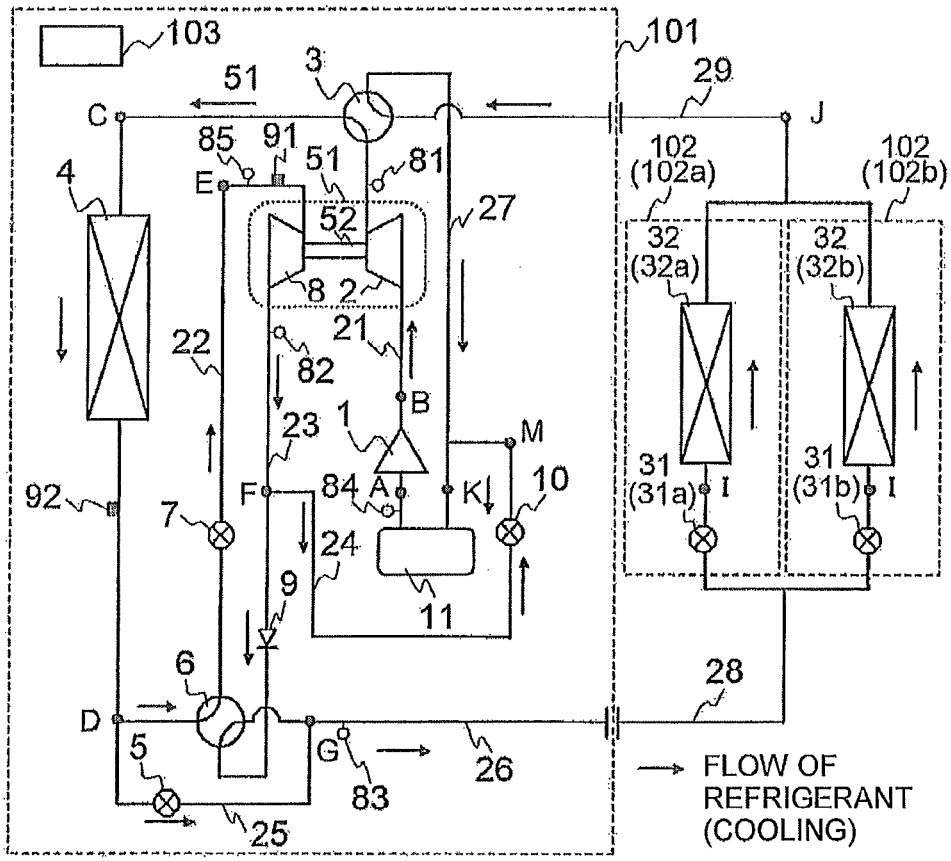
FIG. 1 is a refrigerant circuit diagram during a cooling operation of an air-conditioning apparatus equipped with a refrigeration cycle apparatus according to Embodiment 1 of the invention.
Figure 2:
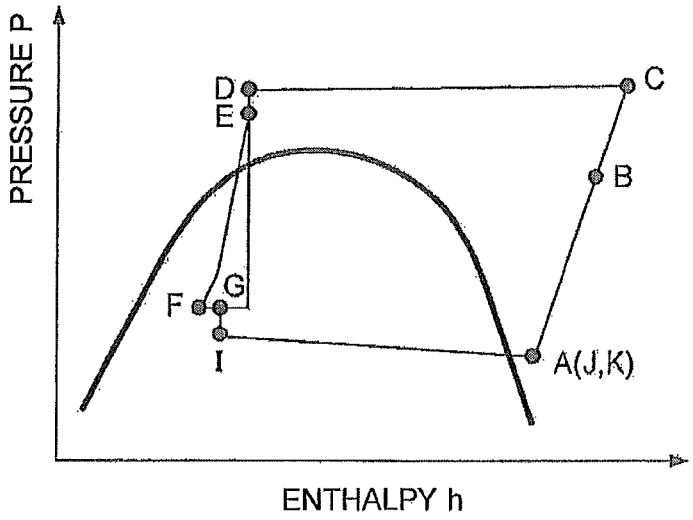
FIG. 2 is a P-h diagram showing the cooling operation of the air-conditioning apparatus according to Embodiment 1 of the invention of FIG. 1.

FIG. 1 is a refrigerant circuit diagram during a cooling operation of an air-conditioning apparatus equipped with a refrigeration cycle apparatus according to Embodiment 1 of the invention. FIG. 2 is a refrigerant circuit diagram during the cooling operation of the air-conditioning apparatus of FIG. 1.

The air-conditioning apparatus of FIG. 1 is equipped with a refrigeration cycle apparatus that is formed by sequentially connecting by means of piping a first compressor 1 that is driven by an electric motor to compress a refrigerant, a second compressor 2, an outdoor heat exchanger 4, an expander 8 that expands the refrigerant that passes therethrough and recovers power from the refrigerant, and an indoor heat exchanger 32. The second compressor 2 and the expander 8 are coupled together with a drive shaft 52, and the second compressor 2 is driven via the drive shaft 52 by the power recovered by the expander 8.

The outdoor heat exchanger 4 becomes a radiator in which an internal refrigerant rejects heat during a cooling operation, and becomes an evaporator in which the internal refrigerant evaporates during a heating operation. Additionally, the indoor heat exchanger 32 becomes an evaporator in which the internal refrigerant evaporates during a cooling operation, and becomes a radiator in which the internal refrigerant rejects heat during a heating operation.

Additionally, this air-conditioning apparatus is equipped with a bypass piping 24 that bypasses the refrigerant to an inlet piping 27 of an accumulator 11 from a discharge piping 23 of the expander 8, and a bypass valve 10 that adjusts the flow rate of the refrigerant that flows through the bypass piping 24.

Additionally, in this air-conditioning apparatus, carbon dioxide is used as the refrigerant, and as compared to conventional chlorofluorocarbon refrigerants, this carbon dioxide has zero ozone depletion potential and a low global warming potential.

In Embodiment 1, the first compressor 1, the second compressor 2, a first four-way valve 3 that is a refrigerant flow switching device, the outdoor heat exchanger 4, a second four-way valve 6 that is a refrigerant flow switching device, a pre-expansion valve 7, the expander 8, a bypass valve 5, the bypass valve 10, and the accumulator 11 are accommodated in an outdoor unit 101. An expansion valve 31*a* and an indoor heat exchanger 32*a* are accommodated in an indoor unit 102*a*, and an expansion valve 31*b* and an indoor heat exchanger 32*b* are accommodated in an indoor unit 102*b*. A control device 103 that controls the overall control of the air-conditioning apparatus is also accommodated in the outdoor unit 101. In addition, although the number of the indoor units 102 (indoor heat exchangers 32) is set to two in Embodiment 1, the number of the indoor units 102 is arbitrary. Additionally, the outdoor unit 101 and the indoor units 102*a* and 102*b* are connected together by a liquid pipe 28 and a gas pipe 29.

The first compressor 1 is driven by an electric motor (not shown) to compress and discharge the sucked-in refrigerant. The second compressor 2 and the expander 8 are accommodated in a container 51. The second compressor 2 is connected to the expander 8 via the drive shaft 52, and power generated in the expander 8 is recovered by the drive shaft 52 and is transferred to the second compressor 2. Hence, the second compressor 2 sucks in the refrigerant discharged from the first compressor 1, and further compresses the refrigerant.

The first four-way valve 3 is provided in a refrigerant channel between the outdoor heat exchanger 4, the second compressor 2, the indoor heat exchanger 32, and the accumulator 11. Additionally, the second four-way valve 6 is provided in a refrigerant channel between the outdoor heat exchanger 4, the expander 8, and the indoor heat exchanger 32. The first four-way valve 3 and the second four-way valve 6 are switched corresponding to the cooling or heating operation mode, on the basis of an instruction from the control device 103, and switch the refrigerant path.

During a cooling operation, the refrigerant flows sequentially from the second compressor 2 to the outdoor heat exchanger 4, the expander 8, the indoor heat exchanger 32, the accumulator 11, and the first compressor 1, and returns to the second compressor 2.

During a heating operation, the refrigerant flows sequentially from the second compressor 2 to the indoor heat exchanger 32, the expander 8, the outdoor heat exchanger 4, the accumulator 11, and the first compressor 1, and returns to the second compressor 2.

The flow direction of the refrigerant that passes through the expander 8 and the second compressor 2 are made to be the same irrespective of the cooling operation and the heating operation by the first four-way valve 3 and second four-way valve 6.

The outdoor heat exchanger 4 has, for example, a heat transfer tube through which the refrigerant flows and fins (not shown) for increasing the heat transfer area between the refrigerant that flows through the heat transfer tube and outdoor air, and exchanges heat between the refrigerant and air (outdoor air). For example, the outdoor heat exchanger functions as an evaporator during a heating operation, and evaporates the refrigerant and gasifies it. On the other hand, the outdoor heat exchanger functions as a condenser or a gas cooler (hereinafter referred to as a condenser) during a cooling operation. Depending on circumstances, the outdoor heat exchanger does not gasify or liquefy the refrigerant completely, but brings the refrigerant into a two-phase mixture (gas-liquid two-phase refrigerant) state of liquid and gas. The accumulator 11 functions to reserve excess refrigerant in a refrigeration cycle or to prevent the first compressor 1 being damaged by return of liquid refrigerant to the first compressor 1 in large quantities.

A refrigerant channel 22 between the second four-way valve 6 and an inlet of the expander 8 is provided with the pre-expansion valve 7 that adjusts the flow rate of the refrigerant that passes through the expander 8. A refrigerant channel 23 between an outlet of the expander 8 and the second four-way valve 6 is provided with a check valve 9 that arranges the direction in which the refrigerant flows to be one direction. A refrigerant channel between the outdoor heat exchanger 4 and the indoor heat exchanger 32 is provided with a bypass piping 25 that bypasses the second four-way valve 6, the pre-expansion valve 7, the expander 8, and the check valve 9, and the bypass valve 5 that adjusts the flow rate of the refrigerant that passes through the bypass piping 25. By adjusting the pre-expansion valve 7 and the bypass valve 5, the flow rate of the refrigerant that passes through the expander can be adjusted to control the pressure on a high-pressure side, and maintain a refrigeration cycle in a highly efficient state. It should be noted that the pressure on the high-pressure side may be controlled by other methods, without being limited to the adjustment of the pre-expansion valve 7 and the bypass valve 5.

The bypass piping 24 that bypasses the expansion valve 31 and the indoor heat exchanger 32, and the bypass valve 10 that adjusts the flow rate of the refrigerant that passes through the bypass piping 24 are provided between the refrigerant outlet of the expander 8 and the refrigerant inlet of the accumulator 11.

A refrigerant outlet of the second compressor 2 is provided with a pressure sensor 81 that detects the pressure of the refrigerant that has come out of the second compressor 2, the refrigerant outlet of the expander 8 is provided with a pressure sensor 82 that detects the pressure of the refrigerant that has come out of the expander 8, the refrigerant channel between the second four-way valve 6 and expansion valve 31 is provided with a pressure sensor 83 that detects the pressure of the refrigerant that flows into the expansion valve 31 or the pressure of the refrigerant that has come out of the expansion valve 31, a refrigerant inlet of the first compressor 1 is provided with a pressure sensor 84 that detects the pressure of the refrigerant that flows into the first compressor 1, and the refrigerant inlet of the expander 8 is provided with a pressure sensor 85 that detects the pressure of the refrigerant that flows into the expander 8.

In addition, the positions of the pressure sensors 81, 82, 83, 84, and 85 are not limited to the above as long as they are positioned to where the pressure of the refrigerant that has come out of the second compressor 2, the pressure of the refrigerant that has come out of the expander 8, the pressure of the refrigerant that flows into the expansion valve 31 or the pressure of the refrigerant that has come out of the expansion valve 31, the pressure of the refrigerant that flows into the first compressor 1, and the pressure of the refrigerant that flows into the expander 8 can be respectively detected. Additionally, as long as pressure can be estimated, the pressure sensors 81, 82, 83, 84, and 85 may be temperature sensors that estimate the temperature of the refrigerant.

The refrigerant inlet of the expander 8 is provided with a temperature sensor 91 that detects the temperature of the refrigerant that flows into the expander 8 and the a piping between the outdoor heat exchanger 4, and the second four-way valve 6 and the bypass valve 5 is provided with a temperature sensor 92 that detects the temperature of the refrigerant that has come out of the outdoor heat exchanger 4 or the refrigerant that flows into the outdoor heat exchanger 4. It should be noted that the position of the temperature sensors 91 and 92 are not limited to the above as long as they are positioned to where the temperature of the refrigerant that flows into the expander 8, and the temperature of the refrigerant that flows into the outdoor heat exchanger 4 or the refrigerant that has come out of the outdoor heat exchanger 4 can be respectively detected.

The indoor heat exchanger 32 has, for example, a heat transfer tube through which the refrigerant flows and fins (not shown) for increasing the heat transfer area between the refrigerant that flows through the heat transfer tube and outdoor air, and exchanges heat between the refrigerant and air (outdoor air). For example, the indoor heat exchanger functions as an evaporator during a cooling operation, and evaporates the refrigerant and gasifies it. On the other hand, the indoor heat exchanger functions as a condenser or a gas cooler (hereinafter referred to as a condenser) during a heating operation.

The expansion valve 31*a* is connected to the indoor heat exchanger 32*a*, and the expansion valve 31*b* is connected to the indoor heat exchanger 32*b*. The expansion valves 31*a* and 31*b* control the flow rates of refrigerants that flow into the indoor heat exchangers 32*a* and 32*b*. When the refrigerant is not sufficiently decompressed by the expander 8, the expansion valves 31*a* and 31*b* adjust the high-low pressure.

<Operation Mode>

Next, the operation during a cooling operation of the air-conditioning apparatus according to Embodiment 1 will be described referring to the refrigerant circuit diagram of FIG. 1 and the P-h diagram of FIG. 2. Note that symbols A to K of FIGS. 1 and 2 correspond to each other. In addition, in the drawings described later, the respective symbols in refrigerant circuits and corresponding P-h diagrams shall also correspond to the above. Now, high/low pressures in the refrigeration cycle or the like are not based on the relationship with a reference pressure; the high/low pressures shall be an expression of relative pressures resulting from the compression by the first compressor 1 and the second compressor 2, the decompression by the bypass valve 6 or the expander 8, or the like. Additionally, the same shall also be true for high/low temperatures. Furthermore, here, the bypass valve 10 shall be closed, and the refrigerant shall not flow through the bypass piping 24.

During a cooling operation, first, a low-pressure refrigerant sucked into the first compressor 1 is compressed and becomes high in temperature and medium in pressure (from State A to State B).

The refrigerant discharged from the first compressor 1 is sucked into the second compressor 2, and is further compressed so as to become high in temperature and high in pressure (from State B to State C).

The refrigerant discharged from the second compressor 2 passes through the first four-way valve 3, and flows into the outdoor heat exchanger 4.

The refrigerant that has radiated heat and transferred heat to the outdoor air in the outdoor heat exchanger 4 becomes low in temperature and high in pressure (from State C to State D).

The refrigerant that has come out of the outdoor heat exchanger 4 branches into a path directed to the second four-way valve 6 and a path directed to the bypass valve 5.

The refrigerant that has passed through the second four-way valve 6 passes through the pre-expansion valve 7 (from State D to State E), is sucked into and decompressed to Low Pressure by the expander 8, and becomes low in dryness (from State E to State F).

At this time, in the expander 8, power is generated with the decompression of the refrigerant, is recovered by the drive shaft 52, is transferred to the second compressor 2, and is used to compress the refrigerant with the second compressor 2.

After the refrigerant discharged from the expander 8 passes through the check valve 9 and the second four-way valve 6, the refrigerant flows toward the bypass valve 5 and merges with the refrigerant that has passed through the bypass piping 25 (from State F to State G), comes out of the outdoor unit 101, and passes through the liquid pipe 28, flows into the indoor units 102*a* and 102*b*, and flows into the expansion valves 31*a* and 31*b*.

The refrigerant is further decompressed in the expansion valves 31*a* and 31*b* (from State G to State I).

The refrigerant that has come out of the expansion valves 31*a* and 31*b* removes heat from the indoor air and evaporates in the indoor heat exchangers 32*a* and 32*b*, and becomes high in dryness while still low in pressure (from State I to State J).

Thereby, the indoor air is cooled.

A refrigerant that has come out of the indoor heat exchangers 32*a* and 32*b* comes out of the indoor units 102*a* and 102*b*, passes through the gas pipe 29, flows into the outdoor unit 101, passes through the first four-way valve 3, flows into the accumulator 11, and is again sucked into the first compressor 1.

By repeating the above-described operation, the heat of the indoor air is transferred to the outdoor air, and the interior of a room is cooled.

Figure 3:
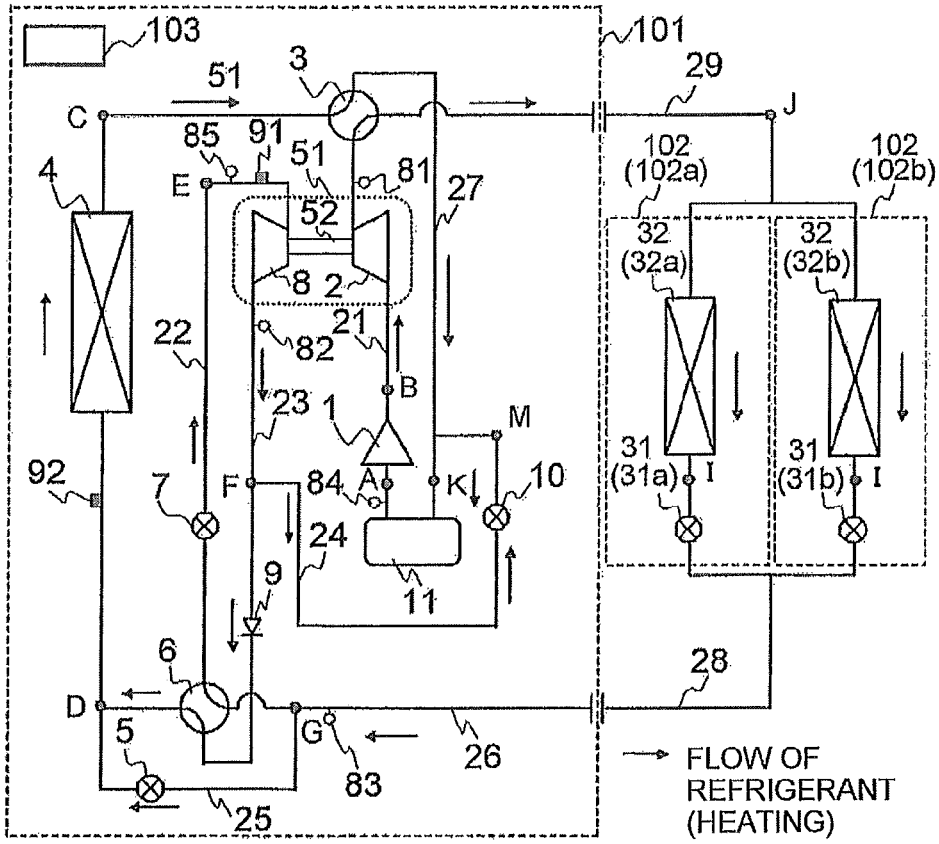
FIG. 3 is a refrigerant circuit diagram during a heating operation of the air-conditioning apparatus according to Embodiment 1 of the invention.
Figure 4:
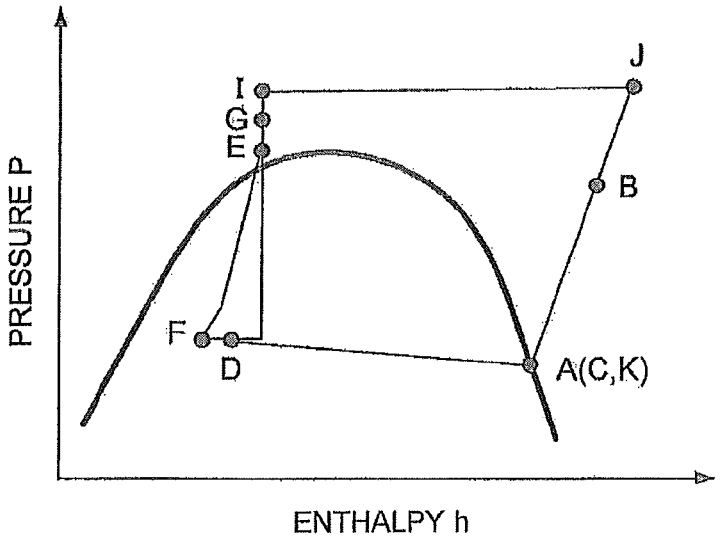
FIG. 4 is a P-h diagram showing the heating operation of the air-conditioning apparatus according to Embodiment 1 of the invention.

Next, the operation during a heating operation of the air-conditioning apparatus according to Embodiment 1 will be described referring to the refrigerant circuit diagram of FIG. 3 and a P-h diagram of FIG. 4. Note that, here, the bypass valve 10 shall be closed, and the refrigerant shall not flow through the bypass piping 24.

During a heating operation, first, a low-pressure refrigerant sucked into the first compressor 1 is compressed, and becomes high in temperature and medium in pressure (from State A to State B).

The refrigerant discharged from the first compressor 1 is sucked into the second compressor 2, and is further compressed so as to become high in temperature and high in pressure (from State B to State J).

The refrigerant discharged from the second compressor 2 passes through the first four-way valve 3, and comes out of the outdoor unit 101.

The refrigerant that has come out of the outdoor unit 101 passes through the gas pipe 29, flows into the indoor units 102*a* and 102*b*, and flows into the indoor heat exchangers 32*a* and 2*b*. The refrigerant that has rejected heat and transferred heat to indoor air in the indoor heat exchangers 32*a* and 32*b* becomes low in temperature and high in pressure (from State J to State I).

The refrigerant that has come out of the indoor heat exchangers 32*a* and 32*b* is decompressed in the expansion valves 31*a* and 31*b* (from State Ito State G).

The refrigerant that has come out of the expansion valves 31*a* and 31*b* comes out of the indoor units 102*a* and 102*b*, passes through the liquid pipe 28, flows into the outdoor unit 101, and branches into the path directed to the second four-way valve 6 and the path directed to the bypass valve 5.

The refrigerant that has passed through the second four-way valve 6 passes through the pre-expansion valve 7 (from State G to State E), flows into and is decompressed to Low Pressure by the expander 8, and becomes low in dryness (from State E to State F). At this time, in the expander 8, power is generated with the decompression of the refrigerant, is recovered by the drive shaft 52, is transferred to the second compressor 2, and is used to compress the refrigerant with the second compressor 2.

After the refrigerant that has come out of the expander 8 passes through the check valve 9 and the second four-way valve 6, the refrigerant flows toward the bypass valve 6 and merges with the refrigerant that has passed through the bypass piping 25 (from State F to State D), and flows into the outdoor heat exchanger 4.

In the outdoor heat exchanger 4, the refrigerant removes heat from the outdoor air and evaporates, and becomes high in dryness while still low in pressure (from State D to State C).

The refrigerant that has come out of the outdoor heat exchanger 4 passes through the first four-way valve 3, flows into the accumulator 11, and is again sucked into the first compressor 1.

By repeating the above-described operation, the heat of the outdoor air is transferred to the indoor air, and the interior of a room is heated.

Next, the structure and operation of a scroll expander 8 and a second scroll compressor 2 as examples of the second compressor 2 and the expander 8 will be described. Note that the second compressor 2 and the expander 8 may be other positive displacement types without being limited to the scroll type.

Figure 5:
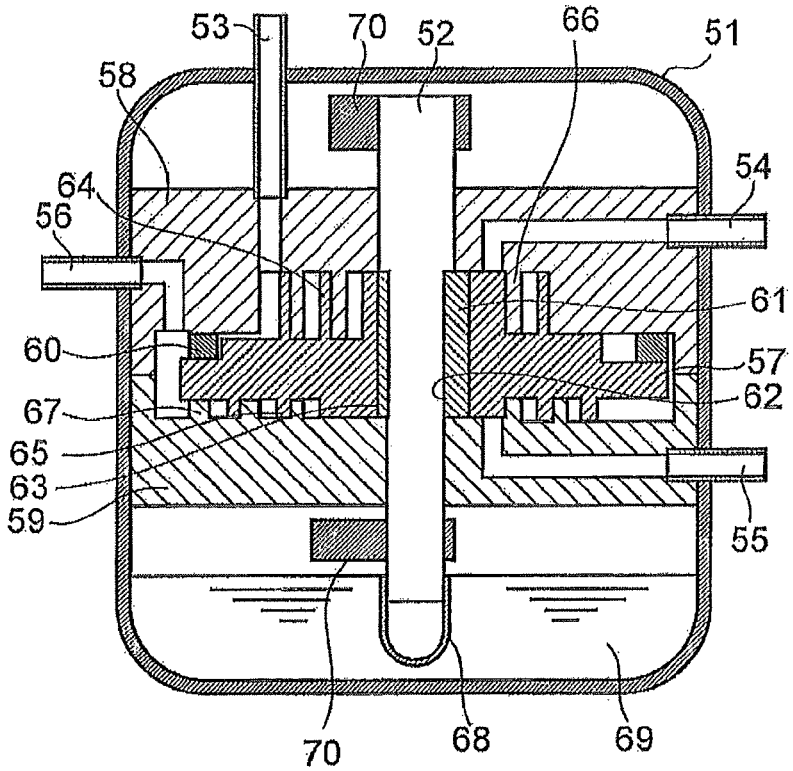
FIG. 5 is a cross-sectional view of a scroll expander integral with a second compressor of the air-conditioning apparatus according to Embodiment 1 of the invention.

FIG. 5 is a cross-sectional view of the scroll expander 8 integral with the second compressor 2. The expander 8 that expands the refrigerant and recovers power is composed of spiral teeth 67 of a fixed scroll 59 of the expander, and spiral teeth 65 on the bottom face of an orbiting scroll 57. Additionally, the second compressor 2 that compresses the refrigerant by the power recovered in the expander 8 is composed of spiral teeth 66 of a fixed scroll 58 of the compressor, and spiral teeth 64 on the top face of the orbiting scroll 57. That is, since the spiral teeth 65 of the expander 8 and the spiral teeth 64 of the second compressor 2 are integrally formed back to back on two faces of a common base plate in the orbiting scroll 57, compression can take place on one side and expansion can take place on the other side, when the orbiting scroll 57 is driven.

A high-temperature and medium-pressure refrigerant discharged from the first compressor 1 is sucked into a suction pipe 53 of the second compressor 2, and is introduced into the outer peripheral side of the second compressor 2 formed by the spiral teeth 66 of the fixed scroll 58 of the compressor, and the spiral teeth 64 of the orbiting scroll 57. Then, by the orbiting of the orbiting scroll 57, the refrigerant is gradually moved to the inner peripheral side in the second compressor 2 and is compressed to high temperature and High Pressure. The compressed refrigerant is discharged from a discharge pipe 54 of the second compressor 2.

On the other hand, a high-pressure refrigerant cooled in the outdoor heat exchanger 4 or the indoor heat exchanger 32 is sucked into a suction pipe 55 of the expander 8, and is introduced into the inner peripheral side of the expander 8 formed by the spiral teeth 67 of the fixed scroll of the expander and the spiral teeth 65 of the orbiting scroll 57. Then, by the orbiting of the orbiting scroll 57, the refrigerant is gradually moved to the outer peripheral side in the expander 8 and is expanded into Low Pressure. The expanded refrigerant is discharged from a discharge pipe 56 of the expander 8. The expansion power of the refrigerant in the expander 8 is recovered via the drive shaft 52, is transferred to the second compressor 2, and is used as compression power.

The afore-mentioned mechanism constituted by the second compressor 2 and the expander 8 is accommodated in the container 51.

Figure 6:
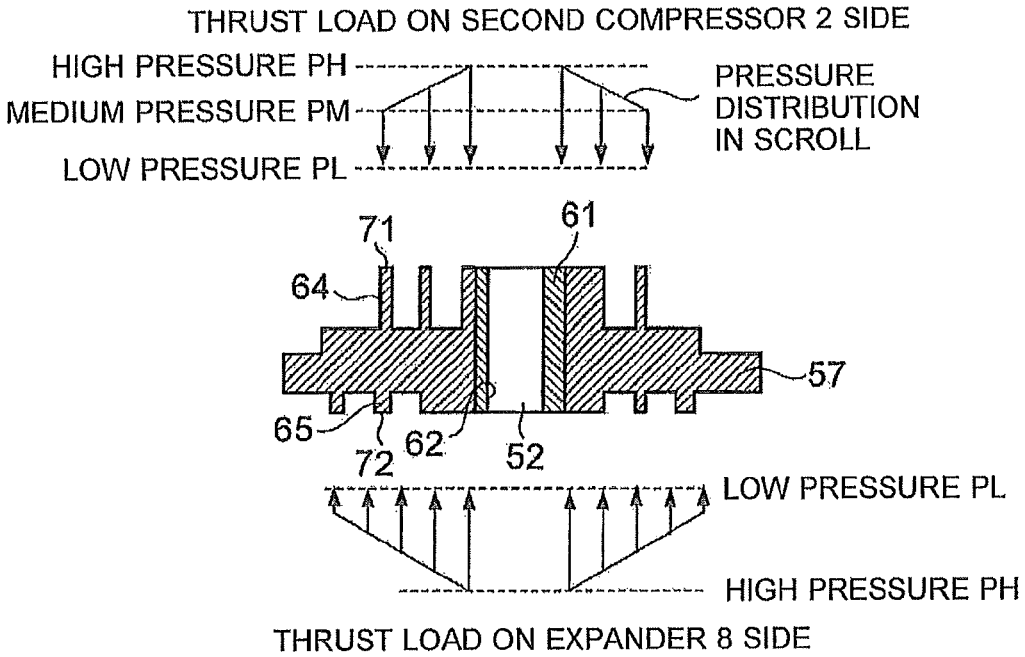
FIG. 6 is a view schematically showing the distribution of a thrust load that acts on second compressor side and the distribution of a thrust load that acts on expander side at design points of the second compressor and the expander of the air-conditioning apparatus according to Embodiment 1 of the invention.

Now, a thrust load (axial load) that acts on the orbiting scroll 57 will be described. FIG. 6 schematically shows distribution of the thrust loads of the second compressor 2 and the expander 8 that act on the second compressor 2 side and the expander side at design points of the second compressor 2. The thrust load that acts on the second compressor 2 side is force that presses the orbiting scroll 57 towards the fixed scroll 59 of the expander 8. The thrust load that acts on the expander 8 side is farce that presses the orbiting scroll 57 towards the fixed scroll 58 of the second compressor 2.

Additionally, as shown in the scroll internal pressure distribution, the discharge pressure of the second compressor 2 will be denoted as High Pressure, the suction pressure of the second compressor 2 will be denoted as Medium Pressure, and the discharge pressure of the expander 8 will be denoted as Low Pressure. Now, the reference pressure of the pressing force will be the Low Pressure.

First, a thrust load that acts on the second compressor 2 by the refrigerant compressed by the second compressor 2 will be obtained. The area in which the orbiting scroll 57 receives the load from the refrigerant compressed in the second compressor 2 is defined as Sc [$mm^2$]. Supposing the mean value of Medium Pressure PM-Low Pressure PL [MPa], which is a difference between the pressure on the outer peripheral side of the second compressor 2 and the reference pressure, and High Pressure PH-Low Pressure PL [MPa], which is a difference between the pressure on the inner peripheral side and the reference pressure, acts on the area Sc, the thrust load Fthc [N] of the second compressor 2 may be obtained by Formula (1).

$$Fthc=(PH+PM-2PL)/2\cdot Sc \quad (1)$$

Next, the thrust load that acts on the expander 8 by the refrigerant that expands in the expander 8 will be obtained. The area in which the orbiting scroll 57 receives the load from the refrigerant that expands in the expander 8 is defined as Se [$mm^2$]. Since the outer peripheral side of the expander 8 is the same Low Pressure as the reference pressure, supposing ½ of High Pressure PH-Low Pressure PL [MPa], which is a difference between the pressure on the inner peripheral side and the reference pressure, acts on the area Se, the thrust load Fthe [N] of the expander 8 may be obtained by Formula (2).

$$Fthe=(PH-PL)/2\cdot Se \quad (2)$$

Supposing the direction of the thrust load Fthc that is going to press the orbiting scroll 57 towards the fixed scroll 59 of the expander 8 is positive, Fthe and Fthc become loads in opposite directions, and the thrust load Fth that acts on the orbiting scroll 57 may be Formula (3).

$$Fth=Fthc-Fthe \quad (3)$$

When the thrust load Fth is excessively large, teeth tips 72 of the spiral teeth 65 of the orbiting scroll 57 are pressed against the fixed scroll 59 of the expander and the friction between the orbiting scroll 57 and the fixed scroll 59 of the expander becomes large. As a result, the power to be recovered in the expander 8 will be lost as friction loss.

When the mean values of the pressure distribution are compared with Formulas (1) and (2), it is clear that the following formula is satisfied.

$$(PH+PM-2PL)/2>(PH-PL)/2 \quad (4)$$

If Se>Sc is structurally set, Fth can be made small. In the design points of FIG. 6, Fth is made small such that the teeth tips 72 of the spiral teeth 65 of the orbiting scroll 57 are moderately pressed against the fixed scroll 59 of the expander, thereby making the friction between the orbiting scroll 57 and the fixed scroll 59 of the expander small.

<Operation of Preventing the Expander from Overexpanding>

During the operation of the air-conditioning apparatus, when the number of operating indoor units 102 changes and the load transitionally fluctuates, the balance of the flow rates between the expander 8 and the second compressor 2 may be disrupted, and the rotation of the second compressor 2 and the expander 8 may become unstable. For example, as in the above-described case, the transitional decrease of the rotational frequency of the second compressor 2 and the expander 8 act as resistance against circulation of the refrigerant and the High Pressure will rise.

Figure 7:
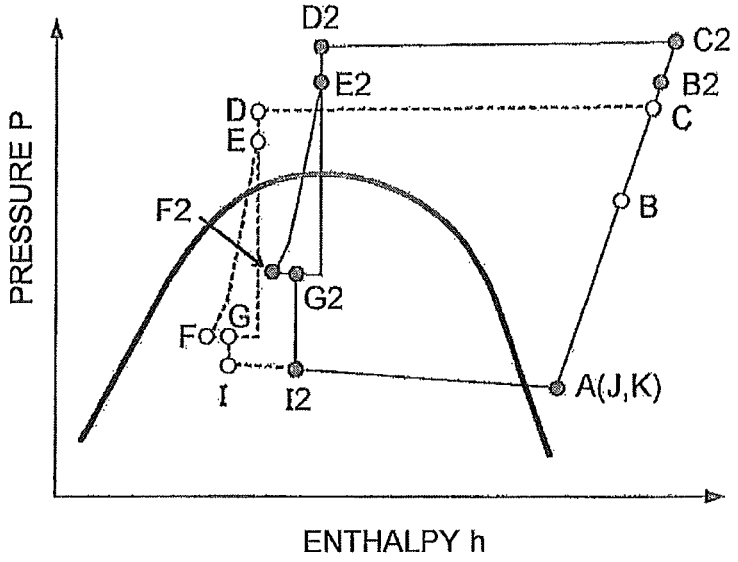
FIG. 7 is a P-h diagram showing a cooling operation when the expander of the air-conditioning apparatus according to Embodiment 1 of the invention overexpands.

Now, an operating state during a cooling operation of the air-conditioning apparatus when the High Pressure of the air-conditioning apparatus has risen transitionally is shown in a P-h diagram of FIG. 7. The discharge pressure (state C2) of the second compressor 2 and the discharge pressure (state D2) of the outdoor heat exchanger 4 rise.

Figure 8:
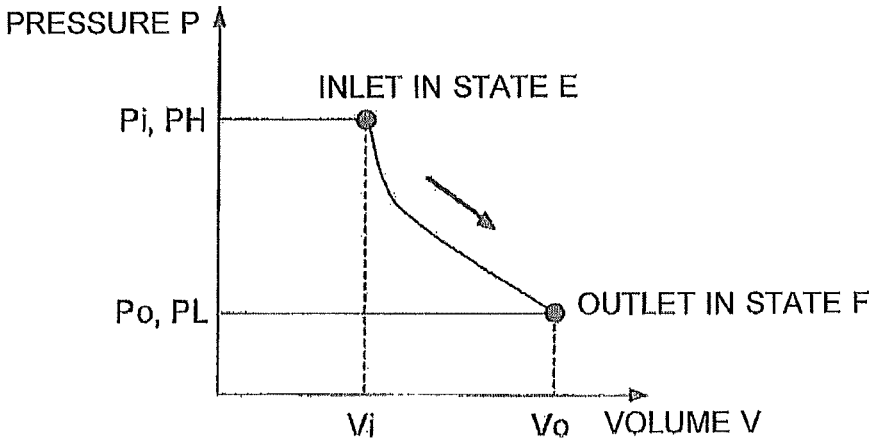
FIG. 8 is a P-v diagram when the expander of the air-conditioning apparatus according to Embodiment 1 of the invention undergoes an appropriate expansion process.
Figure 9:
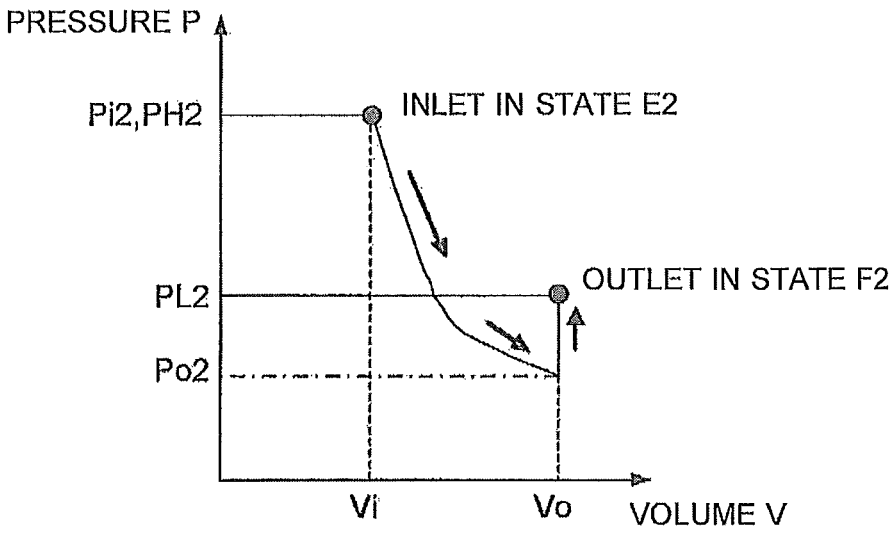
FIG. 9 is a P-v diagram when the expander of the air-conditioning apparatus according to Embodiment 1 of the invention undergoes an overexpansion process.

Now, changes of pressure and volume during the expansion process of the expander 8 will be described. FIG. 8 is a P-v diagram during an appropriate expansion process in which the outlet of the expander 8 is brought into a state F, and FIG. 9 is a P-v diagram during an overexpansion process in which the outlet of the expander 8 is brought into a state F2. In the appropriate expansion process of FIG. 8, the refrigerant is sucked in the state of pressure PH and volume Vei and is separated, by the spiral teeth 67 of the fixed scroll of the expander and the spiral teeth 65 of the orbiting scroll 57, and the separated refrigerant is decompressed while volume V increases. Then, when the volume V, separated by the spiral teeth 67 of the fixed scroll of the expander and the spiral teeth 65 of the orbiting scroll 57, becomes Vo that is its maximum volume, the expansion is completed, the pressure becomes Po. Po is a state in which the pressure is the lowest inside the expander. Po is the pressure obtained by the suction pressure PH of the expander 8 and the expansion volume ratio Vi/Vo of the expander 8, supposing that adiabatic expansion occurs inside the expander 8. After the volume V becomes Vo, the refrigerant, separated by the spiral teeth 67 of the fixed scroll 59 of the expander and the spiral teeth 65 of the orbiting scroll 57, passes through the discharge pipe 56 of the expander 8, and is opened to Low Pressure PL. In the design points of the expander, the pressure Po at which expansion ends and the Low Pressure PL are almost equal.

On the other hand, during the overexpansion process in FIG. 9, the discharge pressure PL2 of the expander 8 is higher than Po2 (appropriate discharge pressure) at which the pressure becomes the lowest during the expansion process of the expander 8. During the overexpansion process of FIG. 9, when the refrigerant, separated by the spiral teeth 67 of the fixed scroll 59 of the expander and the spiral teeth 65 of the orbiting scroll 57, is opened to the discharge pipe 56 of the expander 8 from Po2 at which the pressure becomes the lowest, the pressure rises up to the Low Pressure PL2. As mentioned above, the discharge pressure PL2 of the expander 8 being higher than the appropriate discharge pressure Po2 is referred to as overexpansion. In order to prevent the overexpansion, the operation of appropriately reducing the discharge pressure of the expander 8 may be performed such that the discharge pressure of the expander 8 does not become higher than the appropriate discharge pressure.

Figure 10:
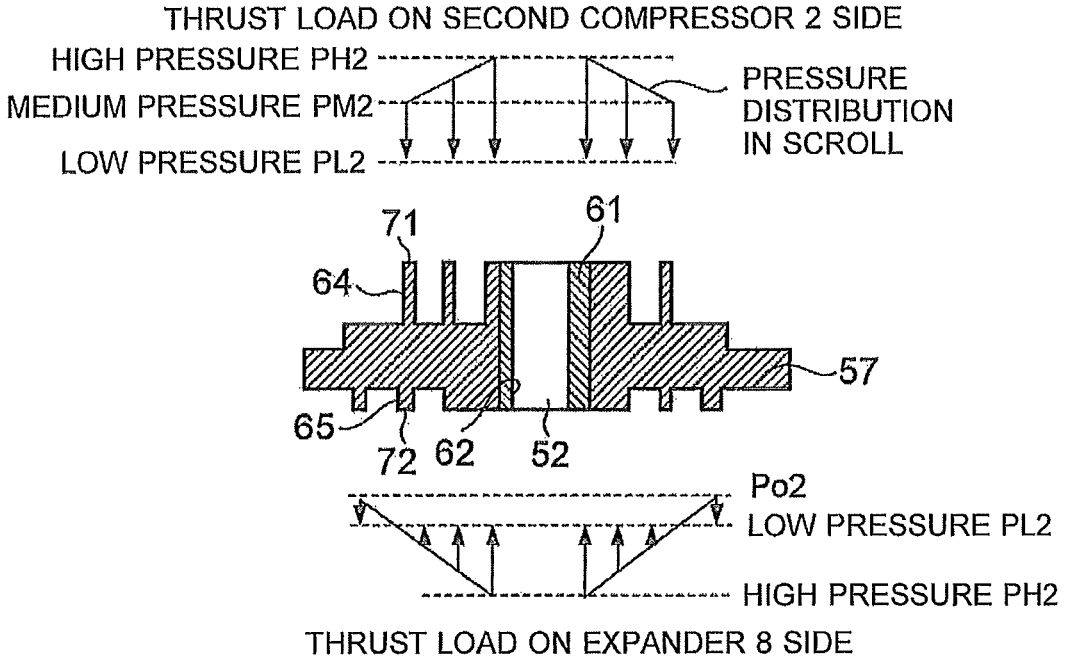
FIG. 10 is a view schematically showing the distribution of a thrust load that acts on the second compressor side and the distribution of a thrust load that acts on the expander side, when the expander of the air-conditioning apparatus according to Embodiment 1 of the invention undergoes the overexpansion process.

FIG. 10 schematically shows the distribution of thrust loads of the second compressor 2 and the expander 8 that act on the second compressor 2 side and the expander 8 side, when the High Pressure is PH2, the Medium Pressure is PM2, and the Low Pressure is PL2. At this time, a thrust load Fthc2 [N] that acts on the second compressor 2 side of the orbiting scroll 57 may be obtained by Formula (5), in the same way as Formula (1), $$Fthc2=(PH2+PM2-2PL2)/2\cdot Sc \quad (5)$$

However, the pressure of the outer periphery of the orbiting scroll 57 on the expander 8 side is the pressure Po2 at which expansion ends, which is lower than the Low Pressure PL2. That is, since force in an opposite direction to the inner peripheral side acts on the outer peripheral side of the orbiting scroll 57, a thrust load Fthe2 that acts on the spiral teeth 65 of the orbiting scroll 57 is expressed by Inequality (6), which is smaller than that obtained by Formula (2).

$$Fthe2<(PH2-PL2)/2\cdot Se \quad (6)$$

Hence, even if the thrust load Fth is designed so as to be small by Formula (3), when an overexpansion process occurs on the expander 8 side as shown in FIGS. 9 and 10, Fthc2 becomes larger than Fthe2 from the design point. As a result, the force with which the orbiting scroll 57 is pressed against the fixed scroll 59 of the expander increases.

When the force with which the orbiting scroll 57 is pressed against the fixed scroll 59 of the expander increases, the friction between the orbiting scroll 57 and the fixed scroll 59 of the expander increases, which acts as resistance while the orbiting scroll 57 is orbiting, and accordingly expansion energy will be lost as friction loss. Additionally, if the friction becomes excessively large, the rotational frequency will decrease.

When the expansion process of the expander 8 becomes an overexpansion process, since the refrigerant is compressed from the pressure Po2, at which expansion ends, until the refrigerant is opened to the Low Pressure PL2, the recovered power in the expander 8 decreases correspondingly, and the driving force of the second compressor 2 decreases. Then, the rotational frequency of the second compressor 2 and the expander 8 further decreases.

As described above, if the rotational frequency of the second compressor 2 and the expander 8 is decreased, the second compressor 2 and expander 8 will act as resistance when the refrigerant circulates. Therefore, this causes a problem in that the High Pressure PH of the air-conditioning apparatus rises excessively.

Thus, in the air-conditioning apparatus according to Embodiment 1, which is a refrigeration cycle apparatus, the discharge pressure of the expander 8 is reduced by the following method, preventing overexpansion during the expansion process in the expander 8. Specifically, the bypass piping 24 that bypasses the refrigerant from the discharge piping 23 of the expander 8 to the inlet piping 27 of the accumulator 11 is provided, and the bypass valve 10 that adjusts the bypass amount of the refrigerant to the bypass piping 24 is provided. As above, by connecting the discharge side of the expander 8 to the suction side of the first compressor 1 that has the lowest pressure within the refrigeration cycle, the discharge pressure of the expander 8 can be reduced, and further, overexpansion can be prevented during the expansion process in the expander 8.

Moreover, the check valve 9 is provided further downstream than a connection port of the bypass piping 24 in the discharge piping 23 of the expander 8. As is clear from FIG. 2, between the state F of the refrigerant on the inlet side of the check valve 9 and the state G of the refrigerant on the outlet side, the state G is higher in pressure. Although the refrigerant flows to a lower pressure side from a higher pressure side, this is prevented by the check valve 9. That is, the check valve 9 prevents the refrigerant that has passed through the bypass piping 25 from flowing from Point G to Point F in FIG. 1, from passing through the bypass piping 24, and from flowing into the accumulator 11.

By virtue of the above-described configuration, the discharge pressure of the expander 8 can be made low even if the air-conditioning apparatus is operating in a state in which the discharge pressure of the expander 8 becomes high.

Figure 11:
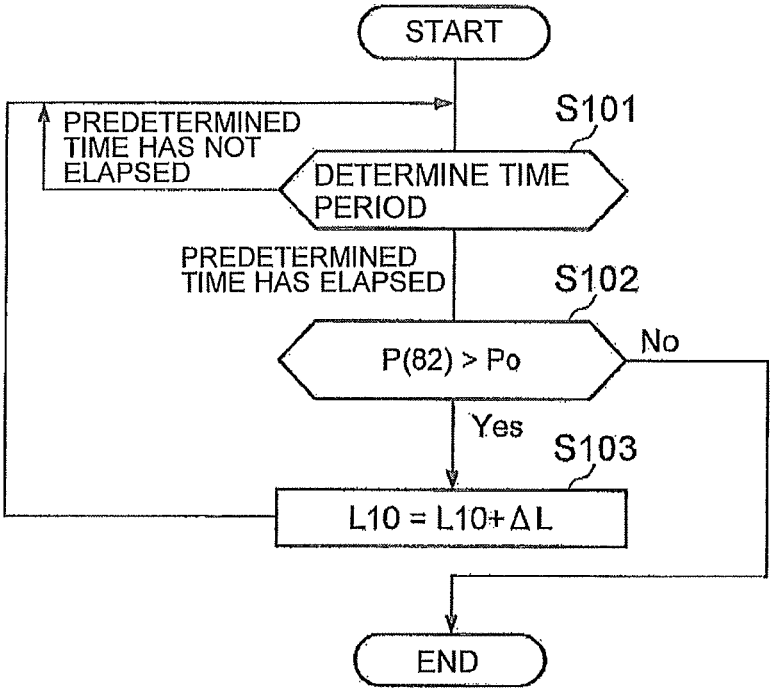
FIG. 11 is a flowchart showing the operation of preventing the expander of the air-conditioning apparatus according to Embodiment 1 of the invention from overexpanding.

Next, the operation of preventing the expander 8 from overexpanding in the air-conditioning apparatus according to Embodiment 1 will be described. FIG. 11 is a flowchart showing the operation of preventing the expander from overexpanding, in the air-conditioning apparatus according to Embodiment 1. It should be noted that, in the following, the pressure P detected by a certain pressure sensor may be, using the symbol of the pressure sensor, designated as P(symbol) (for example, P(83) in the case of the pressure sensor 83).

The air-conditioning apparatus periodically checks the operation of the expander 8 during regular control, such as a usual cooling operation and heating operation, and operates to prevent the expander 8 from overexpanding. That is, the control device 103 determines whether or not a predetermined time period has elapsed during regular control (Step S101). After the predetermined time period has elapsed, the value of the pressure P(82) detected by the pressure sensor 82 is determined whether it is higher than the discharge pressure (appropriate discharge pressure) Po of the expander 8 when undergoing appropriate expansion (Step S102). This appropriate discharge pressure Po, as described above, is determined from the present suction pressure and suction temperature of the expander 8, and the relational data, which is stored in advance in the control device 103, between the suction temperature and the appropriate discharge pressure Po of each suction pressure of the expander 8.

The control device 103 proceeds to Step S104 when it is determined in Step S102 that P(82) is higher than Po, In Step S104, the control device 103 increases an opening degree L10 of the bypass valve 10 provided in the bypass piping 24 by a preset amount ΔL, thereby increasing the flow rate of the refrigerant that flows to the bypass piping 24 (Step S103). As above, by opening the bypass valve 10 and communicating the discharge side of the expander 8 and the suction side of the accumulator 11 that is the lowest in pressure in the refrigeration cycle, passing the refrigerant discharged from the expander 8 to the bypass piping 24 side, decompressing the refrigerant with the bypass valve 10, and then sucking the refrigerant into the accumulator 11, the discharge pressure P(82) of the expander 8 can be lowered.

Then, a control device 102 ends the operation preventing overexpansion by closing the bypass valve 10 when it is determined in Step S103 that P(82) has become lower than Po.

Figure 12:
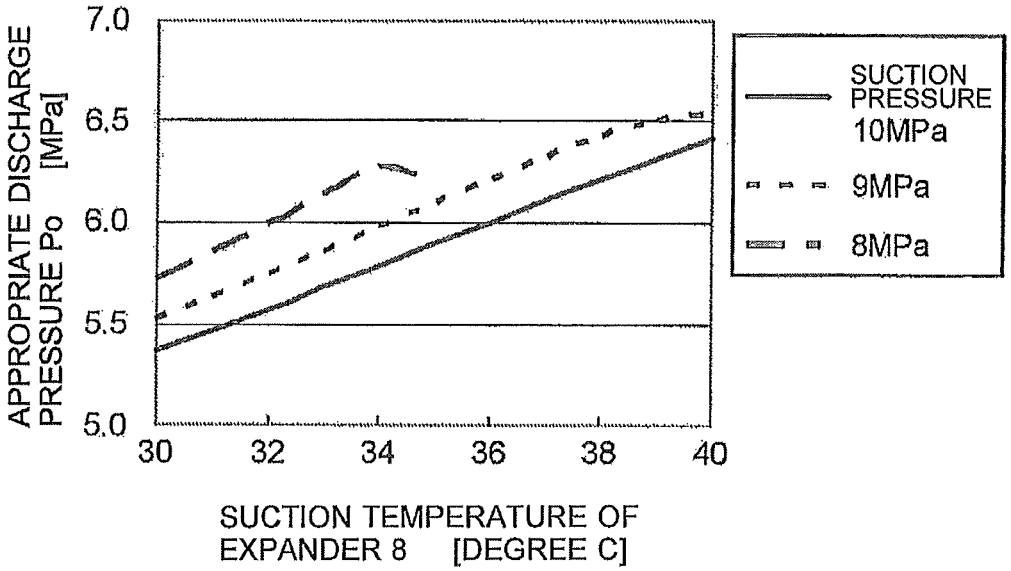
FIG. 12 is a view showing an example of the relationship of an appropriate discharge pressure Po to the suction pressure and suction temperature of the expander according to Embodiment 1 of the invention.

Now, an example of the relationship between the suction temperature and the appropriate discharge pressure Po of each suction pressure of the expander 8 is shown in FIG. 12. FIG. 12 shows the relationship between the suction pressure and the appropriate discharge pressure when the suction pressure is 10 MPa, 9 MPa, and 8 MPa. A specific suction volume is determined from the suction pressure and suction temperature of the expander 8. Additionally, since the relationship between the suction volume Vi and discharge volume Vo of the expander 8 is constant, a specific volume when an expansion process is completed is determined from the specific suction volume of the expander 8. The appropriate discharge pressure Po can be approximately calculated from the specific volume. Hence, the appropriate discharge pressure Po according to the suction pressure and suction temperature of the expander 8 can be approximately estimated from the pressure detected by the pressure sensor 85, which is the suction pressure of the expander 8, the temperature detected by the temperature sensor 91, which is the suction temperature, and the relationship diagram shown in FIG. 12, which is stored in advance by the control device 103.

Figure 13:
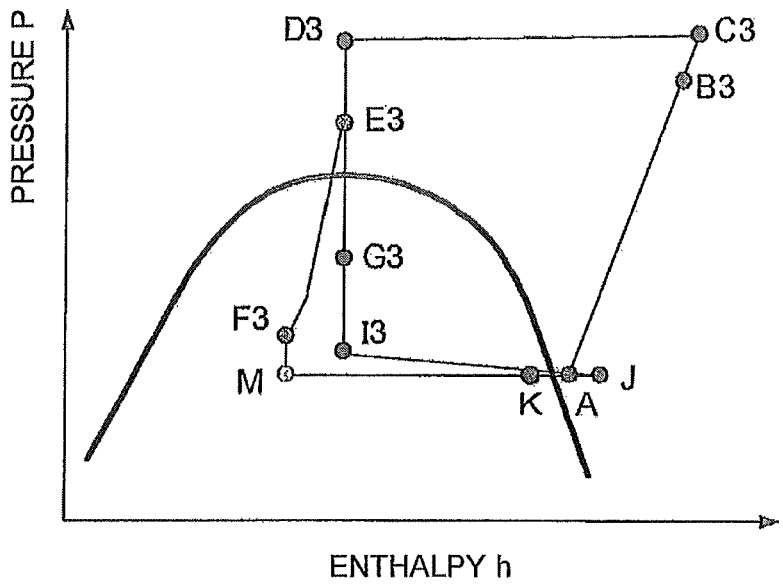
FIG. 13 is a P-h diagram showing an example of the operating state during a cooling operation when the operation of preventing the expander according to Embodiment 1 of the invention from overexpanding is performed.

Now, the operating state of the air-conditioning apparatus during a cooling operation when the aforementioned control of the flowchart in FIG. 11 for preventing the expander 8 from overexpanding is performed will be described using a P-h diagram of FIG. 13.

The refrigerant that has come out of the outdoor heat exchanger 4 branches into a path directed to the second four-way valve 6 and a path directed to the bypass valve 5.

The refrigerant that has passed through the second four-way valve 6 passes through the pre-expansion valve 7 (from State D3 to State E3), is sucked into and decompressed to Low Pressure by the expander 8, and becomes low in dryness (from State E3 to State F3).

The refrigerant discharged from the expander 8 flows into the bypass piping 24 from the discharge piping 23 of the expander 8. Then, the refrigerant is further decompressed by the bypass valve 10 (from State F3 to State M).

On the other hand, the refrigerant (from State D3 to State G3) that has passed through the bypass valve 5 and been decompressed comes out of the outdoor unit 101, passes through the liquid pipe 28, flows into the indoor units 102*a* and 102*b*, and flows into the expansion valves 31*a* and 31*b*. Now, when State G3 of the refrigerant after passing through the bypass valve 5 and State F3 of the refrigerant after passing through the expander 8 are compared, the refrigerant pressure in State G3 is higher. Hence, although the refrigerant flows into the lower pressure side from the higher pressure side, since the check valve 9 is provided here as described above, the refrigerant does not flow to a channel between Point G and Point F of FIG. 1, and all the refrigerant that has passed the bypass valve 5 flows to channels directed to the indoor units 102*a* and 102*b* side.

In the expansion valves 31*a* and 31*b*, the refrigerant is further decompressed (from State G3 to State I3).

The refrigerant that has come out of the expansion valves 31*a* and 31*b* removes heat from the indoor air and evaporates in the indoor heat exchangers 32*a* and 32*b*, and becomes high in dryness while still in a low-pressure state (from State I3 to State J).

The refrigerant that has come out of the indoor heat exchangers 32*a* and 32*b* comes out of the indoor units 102*a* and 102*b*, passes through the gas pipe 29, flows into the outdoor unit 101, passes through the first four-way valve 3, merges with the refrigerant that has passed through the bypass valve 10, and flows into the accumulator 11 (State K).

The refrigerant that has come out of the accumulator 11 is again sucked into the first compressor 1.

At this time, when the bypass valve 10 is opened to flow the refrigerant discharged from the expander 8 into the accumulator 11, the suction pressure of the first compressor 1 may rise. In this case, when opening the bypass valve 10, the opening degree of the pre-expansion valve 7 may be made small to make the suction pressure of the expander 8 low. Additionally, since the refrigerant that flows through the expander 8 decreases when the opening degree of the pre-expansion valve 7 is made small, the bypass valve 5 may be opened in this case.

Additionally, since the check valve 9 is provided further downstream than a connection port of the bypass piping 24 in the discharge piping 23 of the expander 8, the refrigerant that flows through the bypass piping 25 can be prevented from passing through the bypass piping 24 and flowing into the accumulator 11.

Figure 14:
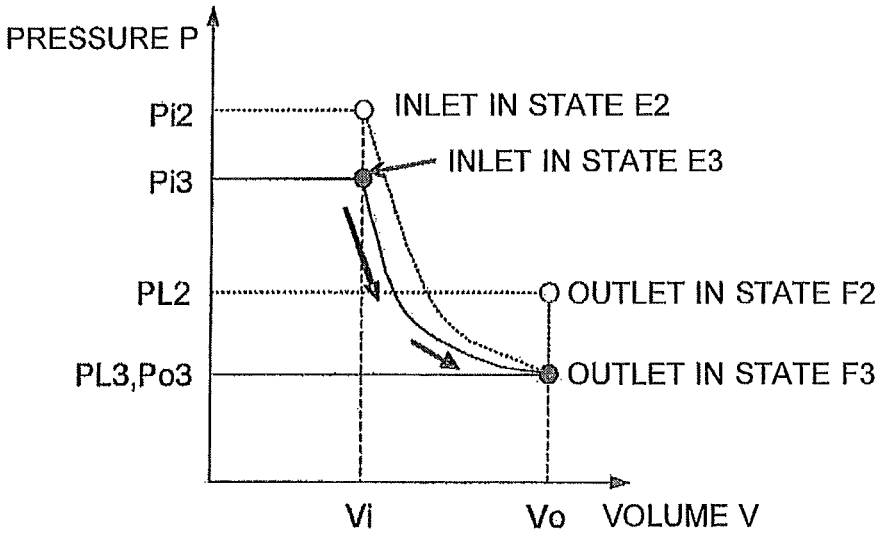
FIG. 14 is a P-v diagram showing an expansion process when the suction pressure of the expander according to Embodiment 1 of the invention becomes low.

FIG. 14 is a P-v diagram showing an expansion process when the suction pressure of the expander is low.

As shown in FIG. 14, by decreasing the opening degree of the pre-expansion valve 7, the suction pressure Pi3 of the expander 8 becomes lower than the suction pressure Pi2 of an inlet Point E2. Thereby, the degree of pressure change and volume change during the expansion process becomes small, and so, compared to when the suction pressure of the expander 8 is high (P12), the difference between the suction pressure Pi of the expander 8 and the appropriate discharge pressure Po becomes small. Thus, it will be easier to bring the discharge pressure PL3 of the expander 8 close to the appropriate discharge pressure Po.

Additionally, the refrigerant discharged from the expander 8 is a low-temperature and low-pressure gas-liquid two-phase refrigerant. If the first compressor 1 directly sucks in this refrigerant, the first compressor 1 performs liquid compression. As a result, the reliability of the compressor is impaired. Thus, in the air-conditioning apparatus according to the present embodiment, the refrigerant that flows through the bypass piping 24 is connected to the inlet piping 27 of the accumulator 11. Therefore, the gas-liquid two-phase refrigerant can be reserved in the accumulator 11 even if the gas-liquid two-phase refrigerant flows to the bypass piping 24. Therefore, the first compressor 1 can be prevented from performing liquid compression.

Additionally, according to Embodiment 1, even if, due to the operating state of the air-conditioning apparatus, the expansion process of the expander 8 transitionally becomes overexpanded during the expansion process of the expander 8 increasing the thrust loads that act on the second compressor 2 and the expander 8, and the driving force of the second compressor 2 further decreases destabilizing the rotation of the second compressor 2 and the expander 8, by opening the bypass valve 10, the discharge pressure of the expander 8 can be reliably lowered and prevent overexpansion. Therefore, the rotation of the second compressor 2 and the expander 8 can be stabilized without the need of stopping the operation of the air-conditioning apparatus.

In the air-conditioning apparatus according to Embodiment 1, since the bypass valve 10 is opened only when the discharge pressure of the expander 8 is higher than the appropriate discharge pressure during regular control, the refrigerant discharged from the expander 8 does not flow into the accumulator 11 ineffectively.

As described above, when the discharge pressure of the expander 8 becomes high during the cooling operation, the operation of preventing overexpansion is performed. The operation of preventing overexpansion is also effective during a heating operation, since the discharge pressure of the expander 8 may become high, for example, when the pressure loss of the outdoor heat exchanger 4 is large during the heating operation. In the case of the heating operation, the saturation pressure of the refrigerant can be calculated from the temperature detected by the temperature sensor 92, and can be adopted as the discharge pressure of the bypass valve 5. Further, the termination condition may be when the discharge pressure of the bypass valve 5 becomes lower than Po.

Additionally, according to Embodiment 1, as shown in FIG. 11, the control of preventing overexpansion begins when the pressure P(82) detected by the pressure sensor 82 becomes higher than the appropriate discharge pressure Po of the expander 8. However, the pressure at which the control starts may be set slightly higher than the appropriate discharge pressure Po of the expander 8. This is because a little overexpansion of the expander 8 will not have immediate, adverse influence on the air-conditioning apparatus. By setting the pressure to start the control slightly higher than the appropriate discharge pressure Po of the expander 8, the air-conditioning apparatus can avoid frequent control of preventing overexpansion when there is some fluctuation in the pressure P(82).

Additionally, although the termination condition by which the control of preventing overexpansion is terminated is set to when the pressure P(83) detected by the pressure sensor 83 becomes lower than the appropriate discharge pressure Po of the expander 8 during a cooling operation, for example, the pressure at which the control is terminated may be slightly lower than the appropriate discharge pressure Po of the expander 8. When during a heating operation, the termination condition by which the control of preventing overexpansion is terminated is set to when the discharge pressure of the bypass valve 5, which is a pressure calculated from the temperature detected by the temperature sensor 92, becomes lower than the appropriate discharge pressure Po of the expander 8. Also in this case, the actual pressure at which the control is terminated may be slightly lower than the appropriate discharge pressure Po of the expander 8. As described above, by setting slight margins to the pressure at which the control of preventing overexpansion is started, and the pressure at which the control of preventing overexpansion is terminated, the control of preventing overexpansion can be prevented from being repeated frequently.

As described above, since the air-conditioning apparatus according to Embodiment 1 opens the bypass valve 10 and prevents the expander 8 from overexpanding when the discharge pressure of the expander 8 is higher than the appropriate discharge pressure, the thrust loads of the second compressor 2 and the expander 8 can be made small. Additionally, since the thrust loads of the second compressor 2 and the expander 8 can be made small, and thereby, the driving force of the second compressor 2 is easily obtained, the rotational frequency of the expander 8 can be stabilized.

Although the air-conditioning apparatus according to Embodiment 1 determines the start of the operation of preventing the overexpansion of the expander 8 (increasing the opening degree of the bypass valve 10 by a predetermined amount ΔL) on the basis of the discharge pressure of the expander 8, other physical quantities of the refrigerant correlated with the discharge pressure of the expander 8 may be adopted. For example, since the discharge pressure of the second compressor 2 rises when the rotational frequency of the second compressor 2 and the expander 8 decrease, the pressure P(81) detected by the pressure sensor 81 may be adopted as a determination factor. Additionally the rotational frequency of the second compressor 2 and the expander 8 may be detected directly, and this rotational frequency may be adopted as a determination factor.

Additionally, in the air-conditioning apparatus according to Embodiment 1, the second compressor 2 is provided in the refrigerant path between the first compressor 1 and the first four-way valve 3, and power is transferred to the second compressor 2 via the drive shaft 52 from the expander 8. As above, the second compressor 2 can use the power generated when the expander decompresses the refrigerant, and the efficiency of the air-conditioning apparatus can be improved.

Additionally, in the air-conditioning apparatus according to Embodiment 1, the orbiting scroll 57 is arranged between the pair of fixed scrolls 58 and 59, and the orbiting scroll 57 is orbitably supported by the drive shaft 52. Also, since the expander 8 is constituted by the fixed scroll 59 of the expander and the orbiting scroll 57 to expand the refrigerant, and the second compressor 2 is constituted by the fixed scroll 58 of the compressor and the orbiting scroll 57 to compress the refrigerant, a small and highly-efficient air-conditioning apparatus can be built.

Additionally, although in the air-conditioning apparatus according to Embodiment 1, the outdoor heat exchanger 4 and the indoor heat exchangers 32*a* and 32*b* are heat exchangers that perform heat exchange with air, heat exchangers that perform heat exchange with other heat media, such as water or brine may be adopted.

Additionally, in the air-conditioning apparatus according to Embodiment 1, the second compressor 2 is provided on the downstream side of the first compressor 1. However, the second compressor 2 may be provided on the upstream side of the first compressor 1.

Additionally, in the air-conditioning apparatus according to Embodiment 1, switching of the refrigerant path corresponding to the operation mode such as cooling or heating is performed by the first four-way valve 3 and second four-way valve 6. However, switching of the refrigerant channel may be performed by configuring a two-way valve, a three-way valve, or a check valve, for example.

Additionally, although the second compressor 2 that operates only by the rotational power transferred from the expander 8 has been described, the invention is of course not limited to this. For example, the second compressor 2 that operates by the rotational power from an electric motor along with the rotational power transferred from the expander 8 may be adopted. Moreover, the power recovered by the expander 8 may be transferred to a generator.

Embodiment 2

The above Embodiment 1 prevents the expander 8 from overexpanding during operation. Embodiment 2 prevents an expander 8 from overexpanding during the start of an air-conditioning apparatus.

Figure 15:
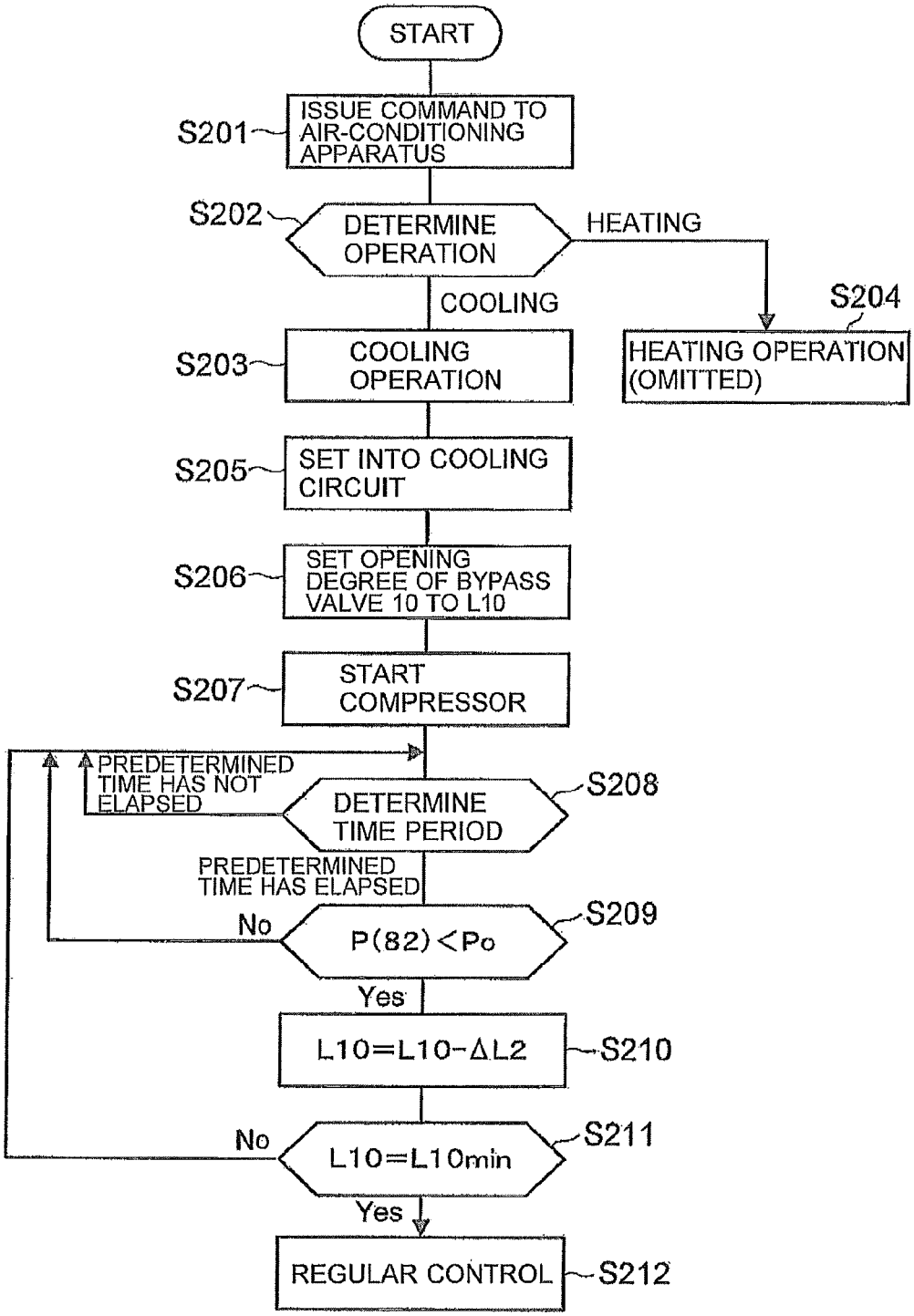
FIG. 15 is a flowchart showing the operation of preventing an expander of an air-conditioning apparatus equipped with a refrigeration cycle apparatus according to Embodiment 2 of the invention from overexpanding.
Figure 16:
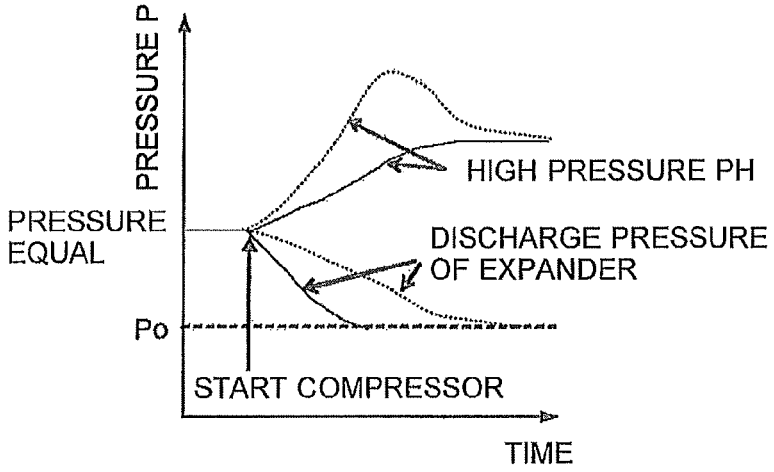
FIG. 16 is a view showing changes in High Pressure and expander discharge pressure when the air-conditioning apparatus according to Embodiment 2 of the invention starts.

FIG. 15 is a flowchart showing an operation according to Embodiment 2 of the invention, preventing the expander 8 from overexpanding. Additionally, FIG. 16 is a graph showing changes in High Pressure and expander discharge pressure during the start of the air-conditioning apparatus. In FIG. 16, a broken line indicates the operation in which no prevention of the expander 8 from overexpanding is performed. In FIG. 16, a solid line indicates the operation in which prevention of the expander 8 from overexpanding is performed, that is, when the control shown in FIG. 15 is performed. Now, FIG. 16 will be briefly described before describing the flowchart in FIG. 15. FIG. 16 shows that a High Pressure PH and expander discharge pressure of the air-conditioning apparatus are equal before the start of a first compressor 1, and the High Pressure PH gradually rises and the expander discharge pressure gradually drops when the first compressor 1 is started.

Hereinafter, the operation of preventing the expander 8 from overexpanding during the start of the air-conditioning apparatus will be described referring to the flowchart in FIGS. 15 and 16.

If an operation command is issued to the air-conditioning apparatus (Step S201), a control device 103 determines whether the air-conditioning apparatus will perform a cooling operation or a heating operation (Step S202). The heating operation (Step S204) is omitted here. If it is determined in Step S202 that the cooling operation will be performed (Step S203), a first four-way valve 3, a second four-way valve 6, and the like are set into a cooling circuit (Step S205). Thereafter, an opening degree of a bypass valve 10 is set to L10 (Step S206). That is, when the first compressor 1 is started, the bypass valve 10 is opened to communicate the discharge side of the expander 8 to the suction side of the first compressor 1. The control device 103 may determine and set the L10 from the frequency when the first compressor 1 starts, for example, so that the pressure loss in the bypass valve 10 does not become so large.

Then, the control device 103 starts the first compressor 1 (Step S207). At this time, since the bypass valve 10 is already opened, the refrigerant discharged from the expander 8 flows from a bypass piping 24 into the first compressor 1 via an accumulator 11. The control device 103 determines whether or not a predetermined time period has elapsed after the starting of the first compressor 1 (Step S208). Immediately after the start of the air-conditioning apparatus, since the temperature and the pressure of the refrigerant transitionally change, the predetermined time period may be as short as about 10 seconds to about 30 seconds.

After the elapse of the predetermined time period, the control device 103 determines whether or not the pressure P(82), detected by a pressure sensor 82, which is the discharge pressure of the expander 8, is lower than an appropriate discharge pressure Po of the expander 8 (Step S209). This appropriate discharge pressure Po, as described above, is determined from the present suction pressure and suction temperature of the expander 8, and a relational data, which is stored in advance in the control device 103, between the suction temperature and the appropriate discharge pressure Po of each suction pressure of the expander 8. At this time, the discharge pressure of the expander 8 during the start of the air-conditioning apparatus, as shown in FIG. 16, is higher than the appropriate discharge pressure. Hence, during the start of the air-conditioning apparatus, Step 209 and Step S208 are repeated, and whenever the predetermined time period elapses, determination of Step S209 is performed.

By starting the first compressor 1, the discharge pressure of the expander 8 gradually drops, as shown in FIG. 16. Then, when the discharge pressure P(82) of the expander 8 becomes lower than Po, the control device 103 reduces the opening degree L10 of the bypass valve 10 by a preset degree ΔL2 (Step S210), and repeats Step S208 to Step S210 until the opening degree of the bypass valve 10 reaches a minimum opening degree L10*min* (S211). That is, the control device 103 gradually closes the bypass valve 10 until the opening degree of the bypass valve 10 becomes the minimum opening degree L10 min. Then, when the opening degree of the bypass valve 10 reaches the minimum opening degree L10*min*, the control device 103 shifts to regular control (Step S212). The overexpansion preventing operation after the control device has shifted to the regular control is the same as that of Embodiment 1.

Now, comparison will be made, referring to FIG. 16 on changes in the refrigerant pressure during the start of the air-conditioning apparatus, between when the operation of preventing the expander 8 from overexpanding is not performed and when the operation of preventing the expander 8 from overexpanding is performed. As shown in FIG. 16, when the operation of preventing the expander 8 from overexpanding is performed, the expander discharge pressure can be made low earlier. That is, since the bypass valve 10 is opened to communicate the discharge side of the expander 8 to the suction side of the first compressor 1 during the start of the air-conditioning apparatus, the expander discharge pressure can be made low earlier compared to when the refrigerant discharged from the expander 8 is passed through a liquid pipe 28 and a gas pipe 29 and is returned to the first compressor 1 (that is, when the operation of preventing the expander 8 from overexpanding is not performed). Hence, it will be easier for a second compressor 2 and the expander 8 to rotate during the start of the air-conditioning apparatus. This can prevent High Pressure from rising during poor rotation of the second compressor 2 and the expander 8 during the start of the air-conditioning apparatus. Additionally, shift to regular control can be made without stopping the air-conditioning apparatus due to the poor rotation of the second compressor 2 and the expander 8.

Meanwhile, a place where the refrigerant has Low Pressure in the air-conditioning apparatus during a cooling operation is from the discharge side of the expander 8 to the suction side of the first compressor 1. However, it may take some time until the pressure on the Low Pressure side will drop after the start of the first compressor 1. For example, corresponding to the above are such cases when the air-conditioning apparatus is a multi-air-conditioning apparatus for a building or the like, having a large number of indoor units 102 and having liquid pipes 28 and gas pipes 29 longer than 50 m. Embodiment 2 may be preferably used in such cases.

Additionally, when the operation of preventing the expander 8 from overexpanding is performed, the ratio of the flow rate of the refrigerant that flows through the bypass piping 24 and the flow rate of the refrigerant that flows through an indoor heat exchanger 32 can be adjusted by adjusting not only the opening degree of the bypass valve 10 but also the opening degrees of a pre-expansion valve 7 and a bypass valve 5.

Additionally, although advantages during the cooling operation have been described above, since an outdoor heat exchanger 4 with a large volume has Low Pressure during a heating operation, and since the pressure on the Low Pressure side does not easily drop, Embodiment 2 is also effective during the heating operation.

Additionally, in the air-conditioning apparatus according to Embodiment 2, after the first compressor 1 has been started, since the opening degree of the bypass valve 10 is decreased to the minimum degree keeping the refrigerant from flowing when the discharge pressure of the expander 8 drops to the appropriate discharge pressure Po, the cooling capacity is not impaired during the cooling operation while the refrigerant bypasses the indoor heat exchanger 32. Additionally, during the heating operation, liquid refrigerant is not permitted to flow into the accumulator 11 excessively.

Embodiment 3

In the above Embodiments 1 and 2, the second compressor 2 directly sucks in the refrigerant discharged from the first compressor 1. In Embodiment 3, the refrigerant discharged from a first compressor 1 is cooled in an intercooler 4*a*, and then sucked into a second compressor 2. Additionally, Embodiment 3 is the same as Embodiment 1 and 2 in the control shown in FIGS. 11 and 15, in which the operation of preventing the expander 8 from overexpanding are performed.

Figure 17:
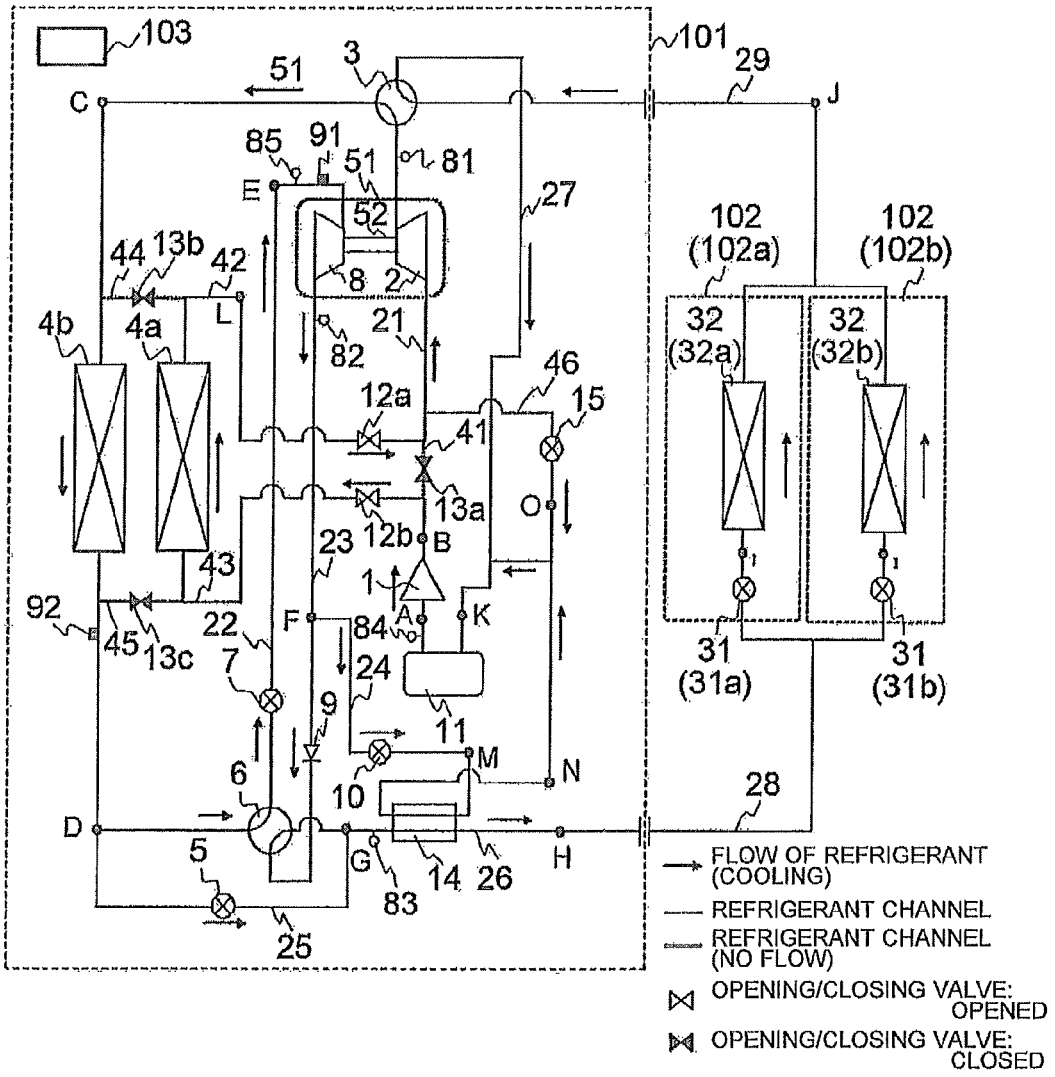
FIG. 17 is a refrigerant circuit diagram during a cooling operation of an air-conditioning apparatus equipped with a refrigeration cycle apparatus according to Embodiment 3 of the invention.

FIG. 17 is a refrigerant circuit diagram during a cooling operation of an air-conditioning apparatus according to Embodiment 3. A refrigerant heat exchanger 14 is provided to exchange heat between the refrigerant (the refrigerant that passes through a first bypass valve 10 and returns to the first compressor 1) that is bypassed to an inlet piping of an accumulator 11 from a discharge piping 23 of an expander 8 and the refrigerant (the refrigerant that is bypassed from a main radiator 4*b* to an indoor heat exchanger 102 that functions as an evaporator) that has passed through a bypass valve 5.

The refrigerant heat exchanger 14 has a channel through which the refrigerant that has passed through the bypass valve 5 passes, and another channel through which the refrigerant passes after passing through the bypass valve 10 of a bypass piping 24 that bypasses from the discharge piping 23 of the expander 8 to the inlet piping of the accumulator 11. An inflow port of the channel is connected to the bypass valve 5 and a second four-way valve 6, and an outflow port of the channel is connected to expansion valves 31*a* and 31*b*. An inflow port of the other channel is connected to the bypass valve 10, and an outflow port of the other channel is connected to the accumulator 11.

Moreover, a bypass piping 46 having one end connected to a suction piping 21 of the second compressor 2, and the other end connected to the inlet piping of the accumulator 11 is provided, and a bypass valve 15 is provided in the bypass piping 46. The bypass valve 15 is opened during the operation of preventing the expander 8 from overexpanding.

The outdoor heat exchanger 4 is divided into two heat exchangers 4*a* and 4*b*. During a cooling operation in which the outdoor heat exchanger 4 mainly functions as a radiator, the heat exchanger 4*a* functions as an intercooler, and the heat exchanger 4*b* functions as a main radiator. Additionally, when the air-conditioning apparatus performs a heating operation, both the heat exchangers 4*a* and 4*b* function as evaporators. In order to change refrigerant path that flows into the outdoor heat exchanger 4 during the cooling operation and heating operation of the air-conditioning apparatus, opening/closing valves 12*a*, 12*b*, 13*a*, 13*b*, and 13*c* are provided.

During a cooling operation, the opening/closing valves 12*a* and 12*b* are opened, and the opening/closing valves 13*a*, 13*b*, and 13*c* are closed. Thereby, the refrigerant discharged from the first compressor 1 flows into the second compressor 2 after passing through the intercooler 4*a*. As above, before the second compressor 2 sucks in the refrigerant discharged from the first compressor 1, the refrigerant is first cooled. Then, the refrigerant discharged from the second compressor 2 flows into the expander 8 after passing through the main radiator 4*b*. By passing the refrigerant discharged from the second compressor 2 through the main radiator 4*b* in this way, the refrigerant discharged from the second compressor 2 is cooled.

During a heating operation, the opening/closing valves 12*a* and 12*b* is closed, and the opening/closing valves 13*a*, 13*b*, and 13*c* are opened. Thereby, the refrigerant discharged from the first compressor 1 is sucked into the second compressor 2. Additionally, the refrigerant that has flowed into the outdoor heat exchanger 4 is directed to the first compressor 1 after flowing in parallel with each of the heat exchanger 4*a* and the heat exchanger 4*b*. The heat exchanger 4*a* and the heat exchanger 4*b* function as evaporators during a heating operation as described above.

Figure 18:
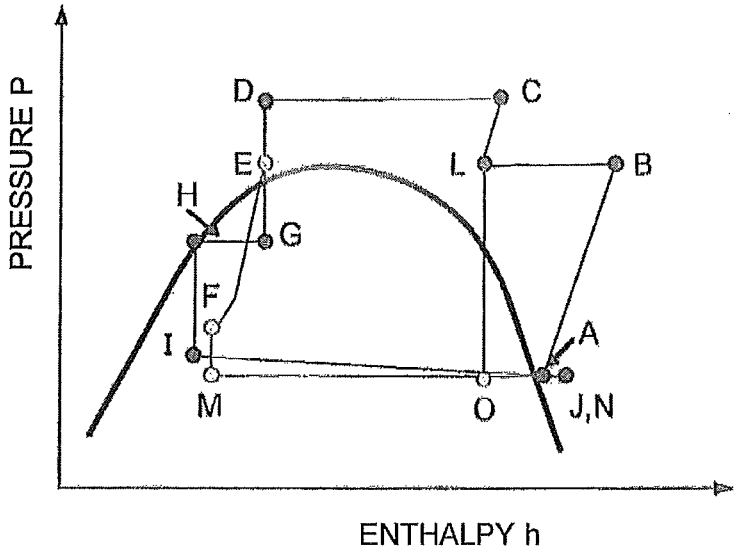
FIG. 18 is a P-h diagram showing the cooling operation of the air-conditioning apparatus according to Embodiment 3 of the invention.

Next, the operation during a cooling operation of the air-conditioning apparatus according to Embodiment 3 will be described referring to the refrigerant circuit diagram of FIG. 17 and the P-h diagram of FIG. 18. As described in Embodiment 1, the operation of the air-conditioning apparatus in a state where the bypass valve 10 is opened as the operation of preventing the expander 8 from overexpanding will be described. In addition, Embodiment 3 is the same as Embodiment 1 in that the refrigerant does not flow to the channel between Point F and Point G in FIG. 17 due to a check valve 9 when the bypass valve 10 is opened.

A gas refrigerant sucked into the first compressor 1 is compressed and is discharged as a medium-pressure and high-temperature supercritical (or gas) refrigerant (from State A to State B).

The refrigerant that has come out of the first compressor 1 flows to the intercooler 4*a* through a piping 43. While the medium-pressure and high-temperature refrigerant is passing through the inside of the intercooler 4*a*, the refrigerant is cooled by the heat exchange with outdoor air and flows out as a medium-pressure and medium-temperature supercritical (or gas) refrigerant (from State B to State L), and is sucked into the second compressor 2 through a piping 42, and the suction piping 21 of the second compressor 2.

At this time, a portion of the refrigerant cooled in the intercooler 4*a* flows through the bypass piping 46, and expands in the bypass valve 15 (from State L to State O).

The refrigerant sucked into the second compressor 2 is further compressed and is discharged as a high-pressure and high-temperature supercritical (or gas) refrigerant (from State L to State C). The refrigerant that has come out of the second compressor 2 flows to the main radiator 4*b* through a first four-way valve 3. While the high-pressure and high-temperature refrigerant passes through the inside of the main radiator 4*b*, the refrigerant is cooled by exchanging heat with the outdoor air, and flows out as a high-pressure and low-temperature supercritical (or liquid) refrigerant (from State C to State D).

The refrigerant that has come out of the main radiator 4*b* branches into a path directed to the second four-way valve 6 and a path directed to the bypass valve 5. The refrigerant that has passed through the second four-way valve 6 passes through a pre-expansion valve 7 (from State D to State E), is sucked into and decompressed to Low Pressure by the expander 8, and becomes low in dryness (from State E to State F). At this time, in the expander 8, power is generated with the decompression of the refrigerant, and this power is recovered by a drive shaft 52, is transferred to the second compressor 2, and is used for compression of the refrigerant by the second compressor 2.

The refrigerant discharged from the expander 8 flows into the bypass piping 24 from the discharge piping 23 of the expander 8, is decompressed in the bypass valve 10 (from State F to State M), and flows into the refrigerant heat exchanger 14 from the inflow port of the other channel of the refrigerant heat exchanger 14. On the other hand, the refrigerant that has flowed out of the outdoor heat exchanger 4 and flowed into a bypass piping 25 is decompressed by the bypass valve 5 (from State F to State G), and flows into the refrigerant heat exchanger 14 from the inflow port of the one channel of the refrigerant heat exchanger 14.

Now, when comparing the refrigerant states of the refrigerants flowing into the channel "on one side" and the channel "on the other side" of the refrigerant heat exchanger 14, the refrigerant in a state M flowing into the channel "on the other side" has a lower pressure and a lower temperature than the refrigerant in a state G flowing into the channel "on one side". Hence, the refrigerant "on the other side" that has flowed into the refrigerant heat exchanger 14 through the bypass valve 10 is heated by exchanging heat with the refrigerant "on one side", and becomes higher in dryness (from State M to State N). On the other hand, the refrigerant "on one side" that has flowed into the refrigerant heat exchanger 14 through the bypass valve 5 is cooled by exchanging heat with the refrigerant "on the other side", and becomes low in dryness (from State G to State H).

The refrigerant "on one side" that has come out of the refrigerant heat exchanger 14 comes out of the outdoor unit 101, passes through the liquid pipe 28, flows into indoor units 102*a* and 102*b*, and flows into the expansion valves 31*a* and 31*b*. In the expansion valves 31*a* and 31*b*, the refrigerant is further decompressed (from State H to a state I).

The refrigerant that has come out of the expansion valves 31*a* and 31*b* removes heat from the indoor air and evaporates in indoor heat exchangers 32*a* and 32*b*, and becomes high in dryness in a low-pressure state (from State Ito State J).

Thereby, the indoor air is cooled.

The refrigerant that has come out of the indoor heat exchangers 32*a* and 32*b* comes out of the indoor units 102*a* and 102*b*, passes through the gas pipe 29, flows into the outdoor unit 101, and passes through the first four-way valve 3. Then, the refrigerant "on the other side" that has come out of the refrigerant heat exchanger 14 and the refrigerant that has passed through the bypass valve 15 merge, and flow into the accumulator 11, and are again sucked into the first compressor 1.

In the air-conditioning apparatus of Embodiment 3, similarly to Embodiment 1, the bypass valve 10 is opened during the operation of preventing the expander 8 from overexpanding. At this time, the bypass valve 15 is also opened so as to flow the refrigerant to the bypass piping 46. The discharge pressure of the second compressor 2 can be adjusted by opening the bypass valve 15. For this reason, when the flow rate of the refrigerant that passes through the expander 8 decreases and the rotational frequency of the expander 8 and the second compressor 2 decrease, the bypass valve 15 can be opened to prevent the discharge pressure of the second compressor 2 from becoming too high. The opening degree of the bypass valve 15 is adjusted, for example, on the basis of the pressure P(81), detected by the pressure sensor 81, which is the discharge pressure of the second compressor 2.

According to the air-conditioning apparatus of Embodiment 3, during the cooling operation, the medium-pressure and high-temperature refrigerant discharged from the first compressor 1 is first cooled in the intercooler 4*a*, and is then further compressed in the second compressor 2. For this reason, compared to when a medium-pressure refrigerant is compressed to High Pressure in the second compressor 2 without being cooled, the power required for a certain compression ratio is smaller in the compression process of the second compressor 2. If the power recovered in the expander 8 is the same, since the amount of a pressure rise in the second compressor 2 can be increased, the amount of pressure rise of the first compressor 1 becomes small. That is, the electric power consumed in the first compressor 1 can be reduced, and the air-conditioning apparatus can further be energy efficient.

Additionally, according to the air-conditioning apparatus of Embodiment 3, heat can be rejected with improved heat transfer capacity because the intercooler 4*a* and the main radiator 4*b* are connected in series during a cooling operation, and pressure loss can be reduced because the intercooler and the main radiator are connected in parallel during a heating operation.

Additionally, according to the air-conditioning apparatus of Embodiment 3, the bypass valve 5 and the bypass valve 15 are adjusted during the start of the air-conditioning apparatus. For this reason, even when the refrigerant flow rates of the second compressor 2 and the expander 8 do not match each other and rotation becomes unstable during the start of the air-conditioning apparatus, the refrigerants that flow through the second compressor 2 and expander 8 may be bypassed appropriately during the start.

Additionally, according to the air-conditioning apparatus of Embodiment 3, during the operation of preventing the expander 8 from overexpanding in the cooling operation, the refrigerant that flows through the bypass piping 24, and refrigerants that flow into the indoor heat exchangers 32*a* and 32*b* exchange heat in the refrigerant heat exchanger 14. For this reason, refrigerating effect can be increased in the indoor heat exchangers 32*a* and 32*b*. Moreover, since the degree of dryness of the refrigerant that flows through the bypass piping 24 can be further increased, the amount of a liquid refrigerant that flows into the accumulator 11 can be made smaller.

Additionally, since the refrigerant that flows into the outdoor heat exchanger 4 during a heating operation is cooled by the refrigerant heat exchanger 14 before the refrigerant flows into the outdoor heat exchanger 4, the degree of dryness of the refrigerant that flows into the outdoor heat exchanger 4 can be made smaller. For this reason, the pressure loss of the refrigerant in the outdoor heat exchanger 4 can be made smaller, or the distribution capacity of the refrigerant in the outdoor heat exchanger 4 can be further improved.

Additionally, according to the air-conditioning apparatus of Embodiment 3, since the refrigerant heat exchanger 14 flows the refrigerants as countercurrents during the cooling operation, heat can be exchanged such that the enthalpy of the refrigerants that flow into the indoor heat exchangers 32*a* and 32*b* is made small during the cooling operation.

Additionally, according to the air-conditioning apparatus of Embodiment 3, during the operation of preventing the expander 8 from overexpanding, the opening degree of the bypass valve 15 is adjusted and accordingly the discharge pressure of the second compressor 2 is adjusted. For this reason, when the flow rate of the refrigerant that passes through the expander 8 decreases and the rotational frequency of the expander 8 and second compressor 2 decrease, the discharge pressure of the second compressor 2 can be prevented from becoming too high. In addition, the bypass valve 15 and the bypass piping 46 may be provided in the refrigerant circuit of Embodiment 1 shown in FIG. 1 in which the same advantages are also obtained.

Additionally, although the air-conditioning apparatus according to Embodiment 3 is configured to cool the medium-pressure and high-temperature refrigerant discharged from the first compressor 1 only during the cooling operation, the air-conditioning apparatus may be configured to perform intercooling even during a heating operation.

Additionally, although the air-conditioning apparatus according to Embodiment 3 is configured to connect the bypass piping 46 to the suction piping 21 of the second compressor 2 and to bypass the refrigerant that has come out of the intercooler 4*a* into the accumulator 11, the air-conditioning apparatus may be configured to bypass the refrigerant discharged from the first compressor 1.

Additionally, in the air-conditioning apparatus according to Embodiment 3, the second compressor 2 is provided on the downstream side of the first compressor 1. However, the second compressor 2 may be provided on the upstream side of the first compressor 1.

Additionally, in each of the above embodiments 1 to 3, an example in which the power recovered by the expander 8 is used as the power of the second compressor 2 is illustrated. However, where power is used is not necessarily limited to the second compressor 2. For example, the above power may be used as the power for the first compressor 1 or the power for a generator used to drive the refrigerant cycle.

REFERENCE SIGNS LIST

1: first compressor, 2: second compressor, 3: first four-way valve, 4: outdoor heat exchanger, 5: bypass valve, 0: second four-way valve, 7: pre-expansion valve, 8: expander, 9: check valve, 10: bypass valve, 11: accumulator, 12*a*, 12*b*: opening/closing valve, 13*a*, 13*b*, 13*c*: opening/closing valve, 14: refrigerant heat exchanger, 15: bypass valve, 21: suction piping of second compressor 2, 22; suction piping of expander 8, 23: discharge piping of expander 8, 24: bypass piping, 25: bypass piping, 26: refrigerant piping, 27: inlet piping of accumulator 11, 28: liquid pipe, 29: gas pipe, 31*a*, 31*b*: expansion valve, 32*a*, 32*b*: indoor heat exchanger, 41, 42, 43, 44, 45: refrigerant piping, 46: bypass piping, 51: container, 52: drive shaft, 53: suction pipe of second compressor 2, 54: discharge pipe of second compressor 2, 55: suction pipe of expander 8, 56: discharge pipe of expander 8, 57: orbiting scroll, 58: fixed scroll of the compressor, 59: fixed scroll of the expander, 60: oldhams ring, 61: slider, 62: shaft insertion hole, 63: driving bearing, 64: spiral teeth on top face of orbiting scroll 57, 65: spiral teeth on bottom face of orbiting scroll 57, 66: spiral teeth of fixed scroll 58 of the compressor, 67: spiral teeth of fixed scroll 59 of the expander, 68: oil pump, 69: lubricating oil, 70: balancer, 71: teeth tips of spiral teeth 64, 72: teeth tips of spiral teeth 65, 81, 82, 83, 84, 85: pressure sensor, 91, 92: temperature sensor, 101: outdoor unit, 102*a*, 102*b*: indoor unit, 103: control device

The invention claimed is:

1. A refrigeration cycle apparatus, comprising:

a refrigeration cycle formed by sequentially connecting with pipes, a first compressor that compresses a refrigerant, a second compressor that further compresses the refrigerant compressed by the first compressor, a radiator that rejects the heat of the refrigerant compressed by the second compressor, an expander that is connected to a drive shaft of one of the first compressor and the second compressor, and that expands the refrigerant that has passed through the radiator, recovers power from the refrigerant and drives the drive shafts with the recovered power, and an evaporator that evaporates the refrigerant expanded by the expander, and an accumulator;

a first bypass piping having one end connected to a discharge piping of the expander and the other end connected to a piping between an inlet piping of the accumulator and the discharge of the evaporator;

a physical quantity detecting sensor that detects a physical quantity of the refrigerant to be sucked into the expander;

a first bypass valve provided in the first bypass piping to control the flow rate of the refrigerant; and control means that controls an opening degree of the first bypass valve, wherein the control means determines an appropriate discharge pressure of the expander on the basis of the physical quantity detected by the physical quantity detecting sensor and opens the first bypass valve when a pressure at which the expander discharges the refrigerant is higher than the determined appropriate discharge pressure.

2. The refrigeration cycle apparatus of claim 1, wherein the control means opens the first bypass valve before starting the first compressor.

3. The refrigeration cycle apparatus of claim 1, wherein the discharge piping of the expander is provided with a check valve that arranges the flow of the refrigerant in one direction.

4. The refrigeration cycle apparatus of claim 1, further comprising:

a second bypass piping that bypasses a portion of the refrigerant that has passed through the radiator to an inlet side of the evaporator being provided between the radiator and the evaporator, the second bypass piping including a second bypass valve; and a refrigerant heat exchanger exchanging heat between the refrigerant directed towards the evaporator via the second bypass valve and the refrigerant directed towards the first compressor via the first bypass valve.

5. The refrigeration cycle apparatus of claim 1, further comprising:

a third bypass piping having one end connected to a discharge piping of the first compressor and the other end connected to the suction piping of the first compressor, wherein the third bypass piping is provided with a third bypass valve that adjusts the flow rate of the refrigerant.

6. The refrigeration cycle apparatus of claim 1, the radiator further comprising;

an intercooler that cools the refrigerant discharged from either the first compressor or the second compressor before the refrigerant is sucked into the other of the first compressor or the second compressor; and a main radiator that cools the refrigerant discharged from the other of the first compressor and the second compressor.

7. The refrigeration cycle apparatus of claim 1, wherein the refrigerant is carbon dioxide.

* * * * *